US008292339B1

(12) United States Patent
Auseklis

(10) Patent No.: US 8,292,339 B1
(45) Date of Patent: Oct. 23, 2012

(54) HANDS FREE PET WASTE COLLECTION SYSTEMS

(76) Inventor: Alexander E. Auseklis, San Francisco, CA (US)

( * ) Notice: Subject to any disclaimer, the term of this patent is extended or adjusted under 35 U.S.C. 154(b) by 89 days.

(21) Appl. No.: 12/764,059

(22) Filed: Apr. 20, 2010

Related U.S. Application Data

(60) Provisional application No. 61/244,716, filed on Sep. 22, 2009, provisional application No. 61/179,194, filed on May 18, 2009.

(51) Int. Cl.
*A01K 29/00* (2006.01)

(52) U.S. Cl. ..... 294/1.4

(58) Field of Classification Search ..... 294/1.3, 294/1.4, 1.5, 54.5; 15/104.8, 257.1, 257.6; 119/161
See application file for complete search history.

(56) References Cited

U.S. PATENT DOCUMENTS

| | | | |
|---|---|---|---|
| 3,738,697 | A | 6/1973 | Kahan |
| 3,971,503 | A | 7/1976 | Allan et al. |
| 3,984,139 | A | 10/1976 | Battaglia |
| 3,986,744 | A | 10/1976 | Krogstad et al. |
| 4,010,970 | A | 3/1977 | Campbell |
| 4,012,067 | A | 3/1977 | Travis |
| 4,014,584 | A | 3/1977 | Bau et al. |
| 4,017,015 | A | 4/1977 | Jefferson |
| 4,021,994 | A | 5/1977 | Mainprice |
| 4,056,278 | A | 11/1977 | Bau et al. |
| 4,097,082 | A | 6/1978 | Orofino |
| 4,103,952 | A | 8/1978 | Thompson |
| 4,103,953 | A | 8/1978 | Lachance |
| 4,119,337 | A | 10/1978 | Sherhandt |
| 4,121,866 | A | 10/1978 | Schall et al. |
| 4,146,259 | A | 3/1979 | Schultz |
| 4,179,145 | A | 12/1979 | Shinsako |
| 4,186,955 | A | 2/1980 | Campbell |
| 4,194,777 | A | 3/1980 | Carns |
| 4,201,409 | A | 5/1980 | O'Hara |
| 4,205,869 | A | 6/1980 | Mathis |
| 4,215,886 | A | 8/1980 | Naderi et al. |
| 4,221,415 | A | 9/1980 | Ganz |
| 4,225,174 | A | 9/1980 | Hennessy et al. |
| 4,230,354 | A | 10/1980 | Claras |
| 4,243,259 | A | 1/1981 | Wright |
| 4,247,139 | A | 1/1981 | Grieb |
| 4,253,691 | A | 3/1981 | Liu |
| 4,257,635 | A | 3/1981 | Mainprice |
| 4,257,636 | A | 3/1981 | Mainprice |
| 4,316,627 | A | 2/1982 | Solypa |
| 4,323,272 | A | 4/1982 | Fortier |
| 4,335,678 | A | 6/1982 | Garza et al. |
| 4,368,907 | A | 1/1983 | Ross |
| 4,383,710 | A | 5/1983 | Fehr |
| 4,444,152 | A | 4/1984 | Berardo |
| 4,447,082 | A | 5/1984 | Lindholm |
| 4,458,932 | A | 7/1984 | Resch |
| 4,477,111 | A | 10/1984 | Crooks |
| 4,500,125 | A | 2/1985 | Olson |
| D279,512 | S | 7/1985 | Schaffer |
| D283,262 | S | 4/1986 | Kline |

(Continued)

*Primary Examiner* — Dean Kramer
*Assistant Examiner* — Stephen Vu
(74) *Attorney, Agent, or Firm* — Stoneman Law Patent Group; Martin L. Stoneman; Kyle Liudahl

(57) ABSTRACT

A system for picking up objects—such as pet waste, debris, and similar noxious materials—and automatically sealing objects within a disposable liner. The liner is installed on a hand-held scooper device by an automatic applicator. The liners comprise a self-sealing feature adapted to assist in encapsulating the waste. The applicator also functions as a storage holder for the hand-held scoop.

19 Claims, 11 Drawing Sheets

U.S. PATENT DOCUMENTS 4,645,252 A 2/1987 Riley
4,717,186 A 1/1988 Yoshioka
4,718,707 A 1/1988 Greenhut
4,741,565 A 5/1988 Bagg
4,765,666 A 8/1988 Parks
4,776,621 A 10/1988 Streit
D298,369 S 11/1988 Shun et al.
4,854,624 A 8/1989 Baymiller
4,865,371 A 9/1989 Egberg
4,875,729 A 10/1989 Peck
4,896,912 A 1/1990 Parnell
4,900,077 A 2/1990 Beck
4,909,553 A 3/1990 Hantover
4,958,871 A 9/1990 Hemans
4,962,956 A 10/1990 Scriptor
5,033,781 A 7/1991 Flood
5,039,148 A 8/1991 Brautovich
5,054,828 A 10/1991 Hantover
5,167,377 A 12/1992 Chalmers
D334,255 S 3/1993 Nelson
D334,638 S 4/1993 Blackman
5,205,107 A 4/1993 Herink
5,236,237 A 8/1993 Shultz
5,269,575 A 12/1993 Parvaresh
5,280,978 A 1/1994 Bohn
5,282,660 A 2/1994 Halling
5,295,721 A 3/1994 Wu
5,318,330 A 6/1994 Dombrowski
5,320,393 A 6/1994 Cortinas
5,335,952 A 8/1994 Clapper
5,350,208 A 9/1994 Heinrichson
5,355,836 A 10/1994 Vallery
5,360,247 A 11/1994 Vachter
5,370,431 A 12/1994 Henninger et al.
5,382,063 A 1/1995 Wesener et al.
5,386,802 A 2/1995 Hang-Fu
5,394,833 A 3/1995 Glass
5,400,572 A 3/1995 Peck et al.
5,409,279 A 4/1995 Magee
5,410,987 A 5/1995 Simmons
5,476,296 A 12/1995 Gross
5,482,337 A 1/1996 Rose
5,503,442 A 4/1996 Lee
5,540,469 A 7/1996 Albert
5,564,762 A 10/1996 Ring
5,564,763 A 10/1996 Mercurio
5,579,812 A 12/1996 Bigwood
5,580,111 A 12/1996 Bohn
5,584,519 A 12/1996 Myles et al.
5,586,521 A 12/1996 Kelley
5,601,321 A 2/1997 Simon
5,620,220 A 4/1997 Khoshnood
5,624,144 A 4/1997 Roche
5,628,537 A 5/1997 Kiemer
5,634,678 A 6/1997 Bailey
5,661,873 A 9/1997 Karet
5,667,264 A 9/1997 Tanahara
5,671,959 A 9/1997 Tsou
5,713,302 A 2/1998 Walter
5,713,616 A 2/1998 Knudson
5,718,469 A 2/1998 Ockerman
5,725,268 A 3/1998 Besasie et al.
5,738,444 A 4/1998 Lantz et al.
5,741,036 A 4/1998 Ring
5,785,369 A 7/1998 Ridley, Sr. et al.
5,799,993 A 9/1998 Lafferty
5,803,293 A 9/1998 Lovekin
5,829,671 A 11/1998 Hawk
5,860,742 A 1/1999 Faircloth, Jr.
5,865,486 A 2/1999 Bussani
5,868,447 A 2/1999 Clark et al.
5,899,510 A 5/1999 Hayes et al.
5,931,117 A 8/1999 Lantz et al.
5,971,452 A 10/1999 Marymor et al.
D418,261 S 12/1999 Betts et al.
6,003,913 A 12/1999 Flumiani
6,012,748 A 1/2000 Franks
6,030,011 A 2/2000 Layton
6,062,168 A 5/2000 Host et al.
6,082,574 A 7/2000 Johnson
6,086,123 A 7/2000 Sowenski et al.
6,098,569 A 8/2000 Kent et al.
6,102,457 A 8/2000 Smith
6,113,166 A 9/2000 Wynn
6,126,215 A 10/2000 Jahns
6,129,050 A 10/2000 Carbajal
6,135,520 A 10/2000 Miller et al.
6,142,543 A 11/2000 Friberg
6,164,710 A 12/2000 Shibuya
6,170,692 B1 1/2001 Johnston
6,196,601 B1 3/2001 Juntunen, Jr.
6,199,737 B1 3/2001 Ringelstetter
6,202,595 B1 3/2001 Atcravi
6,216,634 B1 4/2001 Kent et al.
6,227,473 B1 5/2001 Arnold
6,237,972 B1 5/2001 Jung
6,257,473 B1 7/2001 Ringelstetter
D446,696 S 8/2001 Allison
6,276,300 B1 8/2001 Lewis, II et al.
6,305,322 B1 10/2001 Patel
6,315,448 B1 11/2001 Thrall
6,332,429 B1 12/2001 Gramlich
6,354,243 B1 3/2002 Lewis, II et al.
6,378,577 B1 4/2002 Piner et al.
6,394,514 B1 5/2002 Kidd
6,439,627 B1 8/2002 Devane
6,478,351 B1 11/2002 Nelson
6,478,465 B1 11/2002 Thrall
6,485,073 B2 11/2002 Harrison
6,554,334 B2 4/2003 Rincon Uribe
6,554,335 B1 4/2003 Kelly et al.
6,588,375 B2 7/2003 Benedetti
6,590,146 B1 7/2003 Mrsny
6,641,188 B2 11/2003 Arceo
D483,159 S 12/2003 Boyd
D485,025 S 1/2004 Edwards et al.
6,702,349 B2 3/2004 Clements
6,832,796 B1 12/2004 Minassians
6,837,187 B2 1/2005 Berardo
6,932,399 B2 8/2005 Fonfrias
7,374,215 B2 5/2008 Anderson
7,448,659 B1 11/2008 Auseklis
2004/0004361 A1 1/2004 Foster et al.
2004/0100108 A1 5/2004 Cappellano et al.
2004/0124646 A1 7/2004 Peko
2004/0145196 A1 7/2004 Katz
2005/0111763 A1 5/2005 Jung
2005/0194799 A1 9/2005 Karimi et al.

HANDS FREE PET WASTE COLLECTION SYSTEMS

CROSS REFERENCE TO RELATED APPLICATION

The present application is related to and claims priority from prior provisional application Ser. No. 61/179,194, filed May 18, 2009, entitled "PET WASTE COLLECTION SYSTEMS", and, this application is related to and claims priority from prior provisional application Ser. No. 61/244,716, filed Sep. 22, 2009, entitled "HANDS FREE PET WASTE COLLECTION SYSTEMS", the contents of all of which are incorporated herein by this reference and are not admitted to be prior art with respect to the present invention by the mention in this cross-reference section.

BACKGROUND

This invention relates to providing a system for improved pet waste collection. More particularly, this invention relates to providing a system for the convenient "hands free" application of a disposable liner to a pet-debris scooper adapted to collect and seal the pet waste and similar debris within such liner.

Pet waste left in public areas, such as streets and sidewalks, is a common public health nuisance. It has been estimated that there are currently over seventy-million dogs owned in the United States. Many of the dogs reside in metropolitan areas having high population densities. Many municipalities have enacted local ordinances requiring that the pet owner clean up after their pets. Such tasks are unpleasant and often difficult to perform while managing the pet(s).

Many dog owners resort to the "bag-in-hand" method (alternatively called the "hand-in-bag method). Using a plastic grocery bag, the pet owner inserts their hand in the bag and hand scoops the pet waste, closes the bag, and disposes of the waste in a trash receptacle. Some longtime dog owners have resigned to the above-described primitive method, but new owners are understandably repulsed by the technique. It is therefore clear that a need exists for devices that provide clean and efficient essentially "hands free" collection and disposal of pet waste in a convenient and sanitary fashion. Furthermore, the "hands-free" collection of other types of debris, such as everyday garbage, biohazards, police evidence, etc., would be facilitated by such technology.

OBJECTS AND FEATURES OF THE INVENTION

It is the primary object and feature of the present invention to overcome the above-described problem(s). It is another primary object and feature of the present invention to provide a system for the convenient "hands free" application of a disposable liner to a portable pet-debris scooper. It is a further object and feature of the present invention to provide such a system that comprises an improved pet-debris scooper apparatus.

It is another object and feature of the present invention to provide a system wherein the applicator of the disposable liner additionally functions as a convenient holder for the pet-debris scooper. It is a further object and feature of the present invention to provide such a system in the form of the consumer kit.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a system related to the collecting of objects by a user using at least one substantially non-porous flexible sheet comprising at least one cohesive surface adapted to form a cohesive seal when separate regions of such at least one cohesive surface are brought into contact, such system comprising: at least one sheet holder structured and arranged to hold the at least one substantially non-porous flexible sheet; at least one user grip structured and arranged to assist gripping of such at least one sheet holder by the user; at least one sheet folder structured and arranged to fold the at least one substantially non-porous flexible sheet about the pet waste; and at least one seal-formation assister structured and arranged to assist the formation of at least one such cohesive seal substantially enclosing the objects within the at least one flexible non-porous sheet at least one manually-operated actuator structured and arranged to assist manual actuation of such at least one sheet folder and such at least one seal-formation assister by the user without direct contact of the at least one substantially non-porous flexible sheet by the user. Moreover, it provides such a system wherein such at least one sheet holder comprises: at least one releasable retainer structured and arranged to releasably retain the at least one substantially non-porous flexible sheet on such at least one sheet holder prior to formation of such at least one such cohesive seal; and at least one releaser structured and arranged to release the at least one substantially non-porous flexible sheet from such at least one sheet holder on formation of such at least one such cohesive seal substantially enclosing the objects within the at least one flexible non-porous sheet.

Additionally, it provides such a system wherein such at least one releasable retainer comprises at least one suction cup structured and arranged to releasably retain the at least one substantially non-porous flexible sheet on such at least one sheet holder substantially by differential pressure. Also, it provides such a system wherein such at least one sheet folder comprises: at least one movable member structured and arranged to be movable between the objects and at least one ground surface supporting the objects; and at least one pivot joint structured and arranged to pivotally join such at least one movable member with such at least one sheet holder about at least one rotational axis; wherein such at least one movable member comprises at least one lead-edge portion structured and arranged to movably advance along at least one path extending about such at least one rotational axis; wherein such at least one sheet holder further comprises at least one sheet positioner structured and arranged to continuously position the at least one substantially non-porous flexible sheet substantially between such at least one lead-edge portion and the objects; wherein such at least one lead-edge portion comprises at least one sheet engager structured and arranged to engage the at least one substantially non-porous flexible sheet during such advancement along such at least one path; and wherein the at least one substantially non-porous flexible sheet is folded substantially around the objects during such advancement of such at least one sheet engager along such at least one path.

In addition, it provides such a system wherein such at least one seal-formation assister comprises: intersecting such at least one path of such at least one sheet engager, at least one sheet backer structured and arranged to provide stable backing of at least one folded portion of the at least one substantially non-porous flexible sheet during such engagement with such at least one sheet engager; wherein such advancement of such at least one sheet engager such at least one path compresses such at least one folded portion between such at least one sheet engager and such at least one sheet backer; and wherein such compression forms such cohesive seal. And, it provides such a system wherein such at least one sheet engager comprises at least one substantially resilient material extending substantially along a width of such at least one lead-edge portion.

Further, it provides such a system wherein such at least one sheet holder further comprises: at least one housing comprising at least one housing interior and at least one open bottom portion; wherein such at least one housing comprises at least one arrangement of housing walls structured and arranged to substantially surround such at least one housing interior; wherein such at least one path intersects at least one of such housing walls; and wherein such at least one sheet backer comprises at least one interior surface of such at least one of such housing walls. Even further, it provides such a system wherein such at least one releaser comprises: at least one sheet lifter structured and arranged to lift such at least one folded portion upwardly along such at least one interior surface during such compression of such at least one folded portion between such at least one sheet engager and such at least one sheet backer; wherein such lifting of such at least one folded portion by at least one sheet lifter assists the release of the at least one substantially non-porous flexible sheet from such at least one releasable retainer. Moreover, it provides such a system wherein such at least one sheet lifter comprises: coupled to such at least one movable member, at least one downwardly-projecting sweeper structured and arranged to sweep across the at least one ground surface as such at least one movable member moves along such at least one path; wherein such at least one downwardly projecting sweeping member comprises at least one substantially resilient material extending substantially along a width of such at least one lead-edge portion; and wherein such at least one downwardly projecting sweeping member applies at least one upward force on such at least one sheet engager during contact with the at least one ground surface.

Additionally, it provides such a system further comprising at least one biaser structured and arranged to bias such at least one sheet engager to at least one position separated from such at least one sheet backer. Also, it provides such a system wherein: such at least one movable member comprises at least one scoop structured and arranged to assist scooping of the objects from the at least one ground surface; and such at least one scoop comprises at least one arcuate wall extending substantially between such at least one lead-edge portion and such at least one pivot joint. In addition, it provides such a system further comprising at least one elongated handle having at least one first handle end coupled to such at least one sheet holder and at least one second handle end coupled to such at least one user grip. And, it provides such a system further comprising such at least one substantially non-porous flexible sheet. Further, it provides such a system wherein such at least one releasable retainer comprises: coupled with such at least one substantially non-porous flexible sheet, at least one magnetic material comprising a magnetic attraction to at least one magnetic-field producer; and coupled with such at least one sheet holder, such at least one magnetic-field producer; wherein such at least one substantially non-porous flexible sheet is retained on such at least one sheet holder by at least one releasable magnetic coupling between such at least one magnetic material and such at least one magnetic-field producer.

Even further, it provides such a system wherein: such at least one magnetic material substantially comprises at least one ferrometallic wire; and such at least one magnetic-field producer at least one permanent magnet. Even further, it provides such a system wherein such at least one releasable retainer comprises: coupled with such at least one sheet holder, at least one first portion of at least one two-part hook-and-loop fastener; coupled with such at least one substantially non-porous flexible sheet, at least one second portion of at least one two-part hook-and-loop fastener; wherein the at least one substantially non-porous flexible sheet is held adjacent such at least one sheet holder by removably coupling such at least one first portion and such at least one second portion of such at least one two-part hook-and-loop fastener. Even further, it provides such a system wherein such at least one substantially non-porous flexible sheet further comprises: at least one peripheral stiffener structured and arranged to stiffen such at least one substantially non-porous flexible sheet along at least one contact point with such at least one sheet engager; wherein such stiffening assist in the formation of such cohesive seal. Even further, it provides such a system further comprising at least one sheet dispenser structured and arranged to assist dispensing the at least one substantially non-porous flexible sheet onto such at least one sheet holder without direct contact of the at least one substantially non-porous flexible sheet by the user.

In accordance with another preferred embodiment hereof, this invention provides a method related to the disposal of pet waste through the modification of at least one manually-operated pet-waste scooper having at least one movable jaw adapted to assist collection of the pet waste, such method comprising the steps of: providing at least one substantially non-porous flexible sheet comprising at least one cohesive surface adapted to form at least one cohesive seal when separate regions of such at least one cohesive surface are brought into contact, and at least one first part of at least one two-part coupler; providing at least one second part of such of at least one two-part coupler; providing at least one set of instructions to assist the modification of the at least one manually-operated pet-waste scooper to comprise such at least one second part of such at least one two-part coupler; wherein such at least one manually-operated pet-waste scooper, comprising such at least one second part, is structured and arranged to removably receive such at least one substantially non-porous flexible sheet. Even further, it provides such a method further comprising the step of providing at least one sheet dispenser structured and arranged to assist dispensing such at least one substantially non-porous flexible sheet onto such at least one manually-operated pet-waste scooper comprising such at least one second part. In accordance with a preferred embodiment hereof, this invention provides a system related to the disposal of pet waste by a user using at least one substantially non-porous flexible sheet comprising at least one cohesive surface adapted to form a cohesive seal when separate regions of such at least one cohesive surface are brought into contact, such system comprising: at least one sheet holder structured and arranged to hold the at least one substantially non-porous flexible sheet; at least one user grip structured and arranged to assist gripping of such at least one sheet holder by the user; at least one sheet folder structured and arranged to fold the at least one substantially non-porous flexible sheet about the pet waste; and at least one manually-operated actuator structured and arranged to assist manual actuation of such at least one sheet folder by the user; wherein such at least one sheet folder comprises at least one seal-formation assister structured and arranged to assist the formation of at least one such cohesive seal substantially enclosing the pet waste within the at least one flexible non-porous sheet.

Moreover, it provides such a system wherein such at least one sheet holder comprises: at least one releasable retainer structured and arranged to releasably retain the at least one substantially non-porous flexible sheet on such at least one sheet holder prior to formation of such at least one such cohesive seal; and at least one releaser structured and arranged to release the at least one substantially non-porous flexible sheet from such at least one sheet holder on formation of such at least one such cohesive seal substantially enclosing the pet waste within the at least one flexible non-porous sheet. Additionally, it provides such a system wherein such at least one releasable retainer comprises at least one suction cup structured and arranged to releasably retain the at least one substantially non-porous flexible sheet on such at least one sheet holder substantially by differential pressure.

Also, it provides such a system wherein such at least one sheet folder comprises: at least one movable member structured and arranged to be movable between the pet waste and at least one ground surface supporting the pet waste; and at least one pivot joint structured and arranged to pivotally join such at least one movable member with such at least one sheet holder about at least one rotational axis; wherein such at least one movable member comprises at least one lead-edge portion structured and arranged to movably advance along at least one path extending about such at least one rotational axis; wherein such at least one sheet holder further comprises at least one sheet positioner structured and arranged to continuously position the at least one substantially non-porous flexible sheet substantially between such at least one lead-edge portion and the pet waste; wherein such at least one lead-edge portion comprises at least one sheet engager structured and arranged to engage the at least one substantially non-porous flexible sheet during such advancement along such at least one path; and wherein the at least one substantially non-porous flexible sheet is folded substantially around the pet waste during such advancement of such at least one sheet engager along such at least one path.

In addition, it provides such a system wherein such at least one seal-formation assister comprises: intersecting such at least one path of such at least one sheet engager, at least one sheet backer structured and arranged to provide stable backing of at least one folded portion of the at least one substantially non-porous flexible sheet during such engagement with such at least one sheet engager; wherein such advancement of such at least one sheet engager such at least one path compresses such at least one folded portion between such at least one sheet engager and such at least one sheet backer; and wherein such compression forms such cohesive seal. And, it provides such a system wherein such at least one sheet engager comprises at least one substantially resilient material extending substantially along a width of such at least one lead-edge portion. Further, it provides such a system wherein such at least one sheet holder further comprises: at least one housing comprising at least one housing interior and at least one open bottom portion; wherein such at least one housing comprises at least one arrangement of housing walls structured and arranged to substantially surround such at least one housing interior; wherein such at least one path intersects at least one of such housing walls; and wherein such at least one sheet backer comprises at least one interior surface of such at least one of such housing walls.

Even further, it provides such a system wherein such at least one releaser comprises: at least one sheet lifter structured and arranged to lift such at least one folded portion upwardly along such at least one interior surface during such compression of such at least one folded portion between such at least one sheet engager and such at least one sheet backer; wherein such lifting of such at least one folded portion by at least one sheet lifter assists the release of the at least one substantially non-porous flexible sheet from such at least one releasable retainer. Moreover, it provides such a system wherein such at least one sheet lifter comprises: coupled to such at least one movable member, at least one downwardly-projecting sweeper structured and arranged to sweep across the at least one ground surface as such at least one movable member moves along such at least one path; wherein such at least one downwardly projecting sweeping member comprises at least one substantially resilient material extending substantially along a width of such at least one lead-edge portion; and wherein such at least one downwardly projecting sweeping member applies at least one upward force on such at least one sheet engager during contact with the at least one ground surface.

Additionally, it provides such a system further comprising at least one spring biaser structured and arranged to spring bias such at least one sheet engager to at least one position separated from such at least one sheet backer. Also, it provides such a system wherein: such at least one movable member comprises at least one scoop structured and arranged to assist scooping of the pet waste from the at least one ground surface; and such at least one scoop comprises at least one arcuate wall extending substantially between such at least one lead-edge portion and such at least one pivot joint.

In addition, it provides such a system further comprising at least one elongated handle having at least one first handle end coupled to such at least one sheet holder and at least one second handle end coupled to such at least one user grip. And, it provides such a system further comprising such at least one substantially non-porous flexible sheet. Further, it provides such a system wherein such at least one releasable retainer comprises: coupled with such at least one substantially non-porous flexible sheet, at least one magnetic material comprising a magnetic attraction to at least one magnetic-field producer; and coupled with such at least one sheet holder, such at least one magnetic-field producer; wherein such at least one substantially non-porous flexible sheet is retained on such at least one sheet holder by at least one releasable magnetic coupling between such at least one magnetic material and such at least one magnetic-field producer. Even further, it provides such a system wherein: such at least one magnetic material substantially comprises at least one ferrometallic wire; and such at least one magnetic-field producer at least one permanent magnet.

Even further, it provides such a system wherein such at least one releasable retainer comprises: coupled with such at least one sheet holder, at least one first portion of at least one two-part hook-and-loop fastener; coupled with such at least one substantially non-porous flexible sheet, at least one second portion of at least one two-part hook-and-loop fastener; wherein the at least one substantially non-porous flexible sheet is held adjacent such at least one sheet holder by removably coupling such at least one first portion and such at least one second portion of such at least one two-part hook-and-loop fastener. Even further, it provides such a system wherein such at least one substantially non-porous flexible sheet further comprises: at least one peripheral stiffener structured and arranged to stiffen such at least one substantially non-porous flexible sheet along at least one contact point with such at least one sheet engager; wherein such stiffening assist in the formation of such cohesive seal. Even further, it provides such a system further comprising at least one sheet dispenser structured and arranged to assist dispensing the at least one substantially non-porous flexible sheet onto such at least one sheet holder.

In accordance with another preferred embodiment hereof, this invention provides a method related to the collection of objects through the modification of at least one manually-operated pet-waste scooper having at least one movable jaw adapted to assist collection of the objects, such method comprising the steps of: providing at least one substantially non-porous flexible sheet comprising at least one cohesive surface adapted to form at least one cohesive seal when separate regions of such at least one cohesive surface are brought into contact, and at least one first part of at least one two-part coupler; providing at least one second part of such of at least one two-part coupler; providing at least one set of instructions to assist the modification of the at least one manually-operated pet-waste scooper to comprise such at least one second part of such at least one two-part coupler; wherein such at least one manually-operated pet-waste scooper, comprising such at least one second part, is structured and arranged to removably receive such at least one substantially non-porous flexible sheet.

Even further, it provides such a method further comprising the step of providing at least one sheet dispenser structured and arranged to assist dispensing such at least one substantially non-porous flexible sheet onto such at least one manually-operated pet-waste scooper comprising such at least one second part. In accordance with another preferred embodiment hereof, this invention provides a system related to the disposal of objects by a user using at least one substantially non-porous flexible sheet comprising at least one cohesive surface adapted to form at least one cohesive seal when separate regions of such at least one cohesive surface are brought into contact, such system comprising: sheet holder means for holding the at least one substantially non-porous flexible sheet; user grip means for assisting gripping of such sheet holder means by the user; sheet folder means for folding the at least one substantially non-porous flexible sheet about the objects; and manually-operated actuator means for assisting manual actuation of such sheet folder means by the user; wherein such sheet folder means comprises seal-formation assister means for assisting the formation of at least one such cohesive seal substantially enclosing the objects within the at least one flexible non-porous sheet.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
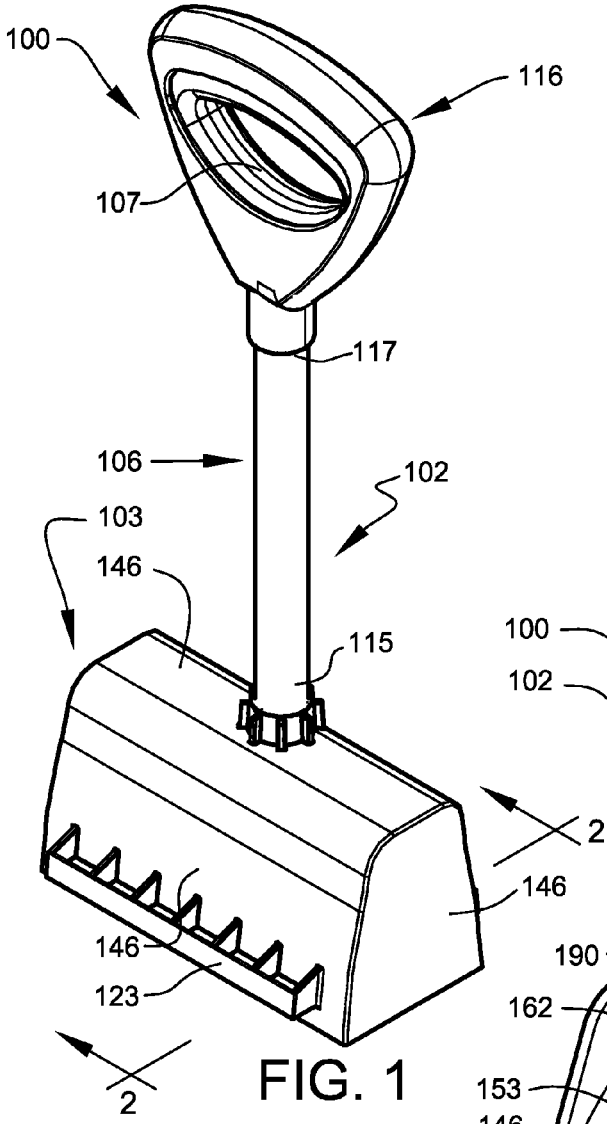
FIG. 1 is a perspective view, illustrating a pet-debris scooper, according to a preferred embodiment of the present invention.
Figure 2:
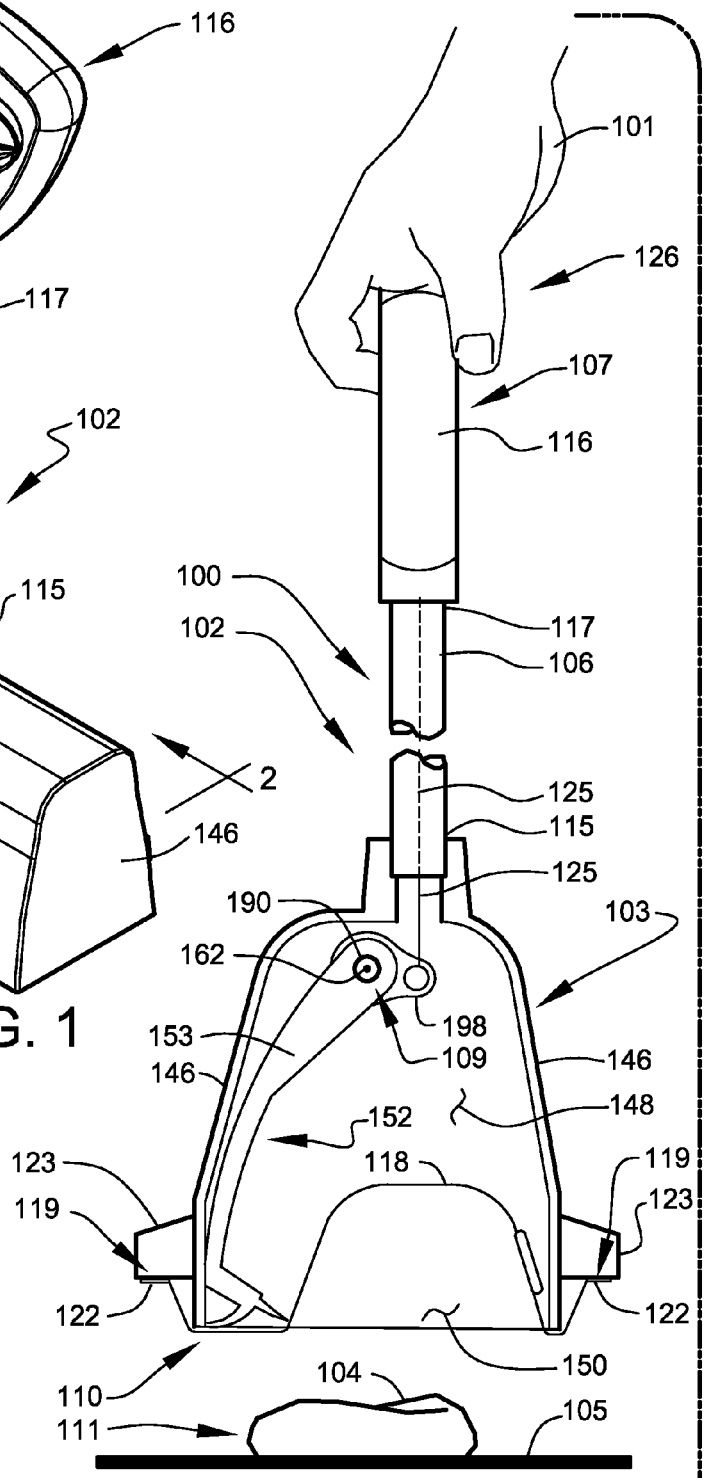
FIG. 2 is a sectional view through the section 2-2 of FIG. 1 diagrammatically illustrating the pet-debris scooper of FIG. 1 assisting a user in the collecting of objects for disposal.

FIG. 1 is a perspective view illustrating pet-debris scooper 102, according to a preferred embodiment of pet-debris scooper system 100. FIG. 2 is a sectional view through the section 2-2 of FIG. 1 diagrammatically illustrating pet-debris scooper 102 of FIG. 1 assisting user 101 in the collection of objects 111 for disposal. In the present disclosure, "objects" refer to materials or substances that are preferably collected without direct contact by the hand of the collector. At least one class of objects collectable by the preferred embodiments of the system preferably includes pet waste 104. In the present disclosure, the term "pet waste" refers to pet droppings (feces) but may include other pet waste materials including vomit or vector-carrying objects retrieved by the pet including vermin, etc. In addition, the preferred embodiments of the system may be used to collect other materials and contaminated substances such as, for example biologically-hazardous matter, garbage, police evidence, etc.

In the present disclosure, objects in the form of pet waste 104 will be used to assist in describing the preferred structures and operation of the system embodiments. Pet-debris scooper 102 is preferably designed to assist user 101 in picking up objects, such as pet waste 104, from a ground surface 105 and sealing the pet waste 104 within a substantially non-porous disposable liner 118. Once encapsulated within disposable liner 118, the pet waste 104 along with the liner can be disposed of in a convenient and sanitary manner. Without disposable liner 118, pet-debris scooper 102 would become soiled with pet waste 104 during collection. Cleaning a scooping device without a disposable liner 118 would be an arduous, malodorous, and unsanitary task.

Pet-debris scooper 102 is preferably fitted with disposable liner 118 prior to use. Disposable liners 118 are preferably constructed of a relatively lightweight and flexible material with sheet plastic being most preferred. Disposable liner 118 is preferably adapted to form a bag-like covering surrounding and encapsulating pet waste 104 prior to disposal. In addition, disposable liner 118 functions as a barrier to protect pet-debris scooper 102 from soiling by pet waste 104 during collection.

Pet-debris scooper 102 preferably comprises an elongated handle 106 having a first handle end 115 coupled to a lower scooper housing 103 and a second handle end 117 coupled to an upper gripping-portion 116, as shown. The upper gripping-portion 116 preferably comprises an ergonomically-contoured shape, as shown, to assist user 101 in supporting the lower scooper housing 103 by grasping gripping-portion 116 with either the right or left hand (at least embodying herein user grip means for assisting gripping of such sheet holder means by the user).

Figure 3:
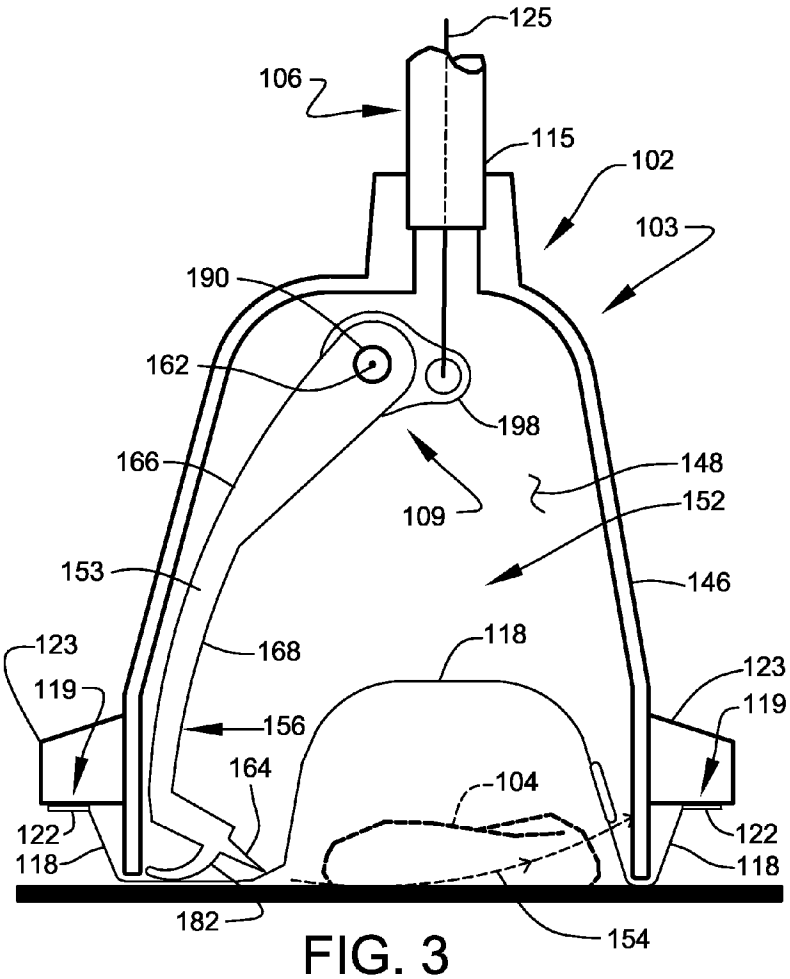
FIG. 3 is a diagrammatic sectional view through the lower portion of the pet-debris scooper of FIG. 1, illustrating a preferred arrangement of operable internal components, according the preferred embodiment of FIG. 1.

The preferred configuration of lower scooper housing 103 is that of a box-like enclosure, preferably formed from an arrangement of generally planar outer walls 146 interconnected to form a substantially hollow internal compartment 148, as shown (at least embodying herein at least one housing comprising at least one housing interior). Upon reading this specification, those with ordinary skill in the art will now appreciate that, under appropriate circumstances, considering such issues as cost, user preference, etc., other housing geometries such as, for example, cylindrical housing shapes, etc., may suffice. Internal compartment 148 preferably comprises a substantially open bottom portion 150 (at least embodying herein and at least one open bottom portion) allowing user 101 to lower scooper housing 103 over pet waste 104 in preparation for collection (as generally illustrated in FIG. 3).

The lower scooper housing 103 is preferably adapted to support two principal sub-assemblies identified herein as sheet holder 110 and sheet-folder 152. Sheet holder 110 is preferably adapted to hold at least one disposable liner 118 in an operable position adjacent the underside of scooper housing 103, as shown. Sheet holder 110 (at least embodying herein sheet holder means for holding the at least one substantially non-porous flexible sheet) preferably comprises a releasable retainer 119 functioning to retain disposable liner 118 on the underside of scooper housing 103 prior to and during use (at least embodying herein at least one releasable retainer structured and arranged to releasably retain the at least one substantially non-porous flexible sheet on such at least one sheet holder prior to formation of such at least one such cohesive seal). In a preferred arrangement, opposing peripheral edges 120 of disposable liner 118 are attached to the external support flanges 123 of scooper housing 103, as shown. Most preferably, the peripheral edges 120 of disposable liner 118 comprise an adhering strip 122 adapted to adhere to the underside of a respective support flange 123, as shown. Specifics of the preferred means of attachment are further described in FIG. 6A.

The primary function of sheet-folder 152 is to fold the attached disposable liner 118 about pet waste 104, without requiring the user to directly manipulate disposable liner 118 with their hands 126 (at least embodying herein sheet folder means for folding the at least one substantially non-porous flexible sheet about the objects). In the present teachings, the term "folding" shall be understood to include in the definition a range of sheet-modifying movements, not limited to; bending, circumvolution, creasing, crimping, curling, curving, deflecting, distorting, encasing, enclosing, enveloping, flexing, furrowing, gathering, lapping, layering, looping, overlapping, pleating, puckering, turning, wrapping, etc. Relieving the pet owner of the need to touch disposable liner 118 or get their hands and nose anywhere near the pet waste 104 is an important function of preferred embodiments of pet-debris scooper system 100.

The bag is loaded on the scooper via a hands-free method. The bag is sealed via a hands-free system. The sealed bag containing the collected object can be dropped into the garbage by using a manually-operated actuator in the hand grip. Keeping a user's hands (and nose) away from the waste offers clear advantages to a user of the system. A secondary function of sheet-folder 152 is to assist the sealing of pet waste 104 within disposable liner 118, as will be described within the descriptions of FIG. 6A.

The operation of sheet-folder 152 is preferably controlled by hand-operated actuator 107, preferably located within gripping-portion 116, as shown. The preferred upper positioning of hand-operated actuator 107 allows the user to manually operate sheet-folder 152 while standing in a relatively upright position (at least embodying herein manually-operated actuator means for assisting manual actuation of such sheet folder means without direct contact of the at least one substantially non-porous flexible sheet by the user; and at least embodying herein at least one manually-operated actuator structured and arranged to assist manual actuation of such at least one sheet folder and such at least one seal-formation assister by the user without direct contact of the at least one substantially non-porous flexible sheet by the user). In addition, the above-described remotely-controlled arrangement serves to maximize the distance between pet waste 104 and the nose of the user.

As illustrated in FIG. 2, sheet-folder 152 preferably comprises a movable member 153 positioned substantially within internal compartment 148, as shown. Movable member 153 is preferably coupled to scooper housing 103 by pivot coupler assembly 109, as shown. Pivot coupler assembly 109 (at least embodying herein at least one pivot joint) is preferably structured and arranged to join movable member 153 with scooper housing 103 in a manner preferably enabling rotation of movable member 153 about rotational axis 162, as illustrated in FIG. 2 through FIG. 7 (this arrangement at least embodying herein at least one movable member structured and arranged to be movable between the objects and at least one ground surface supporting the objects). Upon reading this specification, those with ordinary skill in the art will now appreciate that, under appropriate circumstances, considering such issues as intended use, user preference, etc., other pivot arrangements such as, for example, utilizing a "movable" (non-fixed) pivot axis to improve pickup performance, etc., may suffice. A preferred sequence of operation is diagrammatically illustrating in FIG. 3 through FIG. 5.

Figure 4:
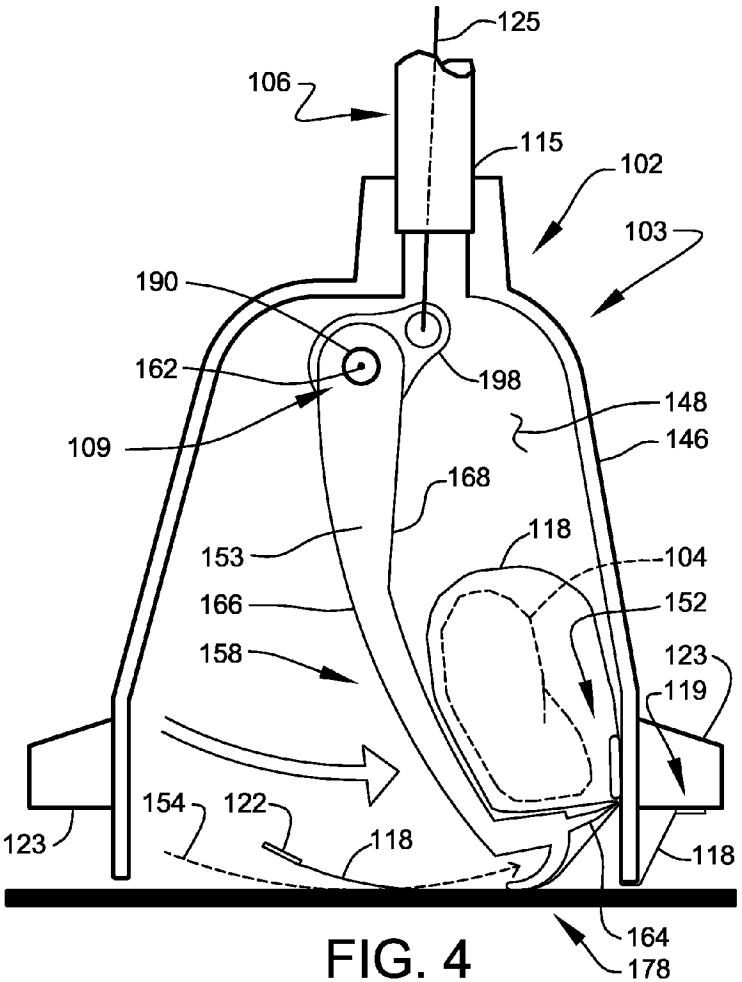
FIG. 4 is a second diagrammatic sectional view through the lower portion of the pet-debris scooper of FIG. 1, illustrating a secondary position of the preferred arrangement of operable internal components.
Figure 5:
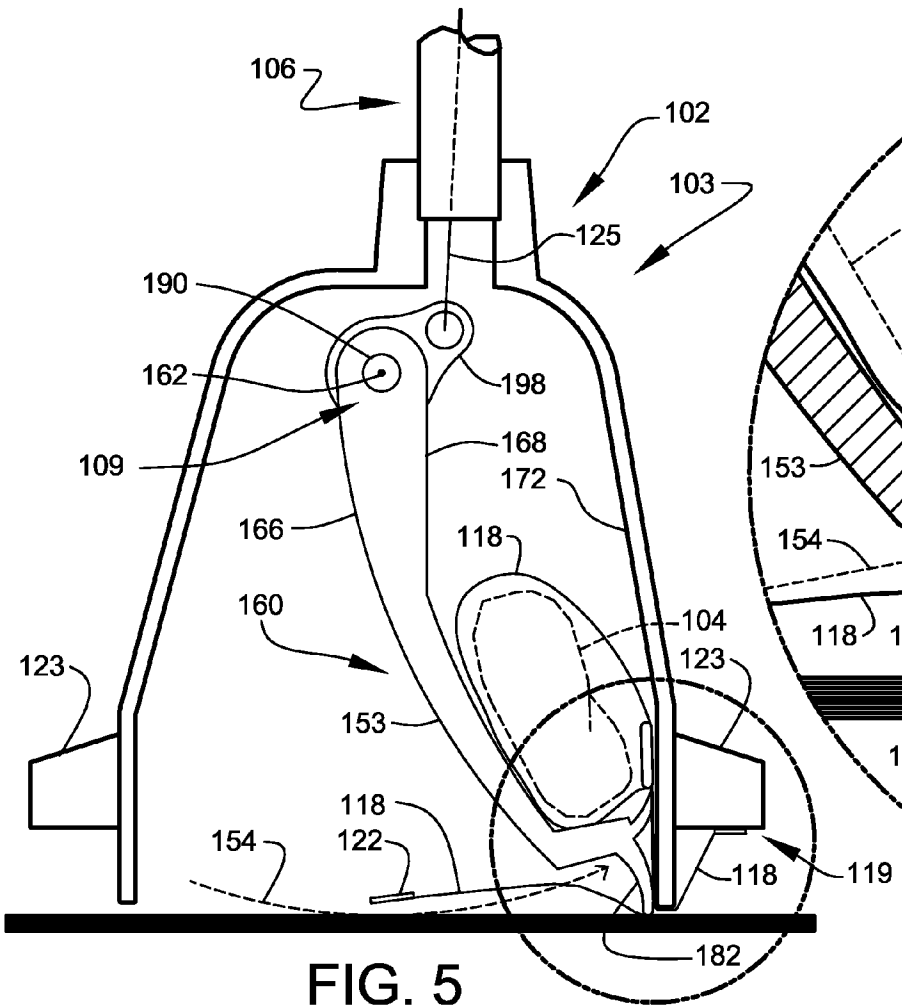
FIG. 5 is a third diagrammatic sectional view through the lower portion of the pet-debris scooper of FIG. 1, illustrating a tertiary position of the preferred arrangement of operable internal components.

FIG. 3 is a diagrammatic sectional view through scooper housing 103 further illustrating preferred arrangements of sheet-folding assembly 152. In the depiction of FIG. 3, movable member 153 is shown in the starting position 156. FIG. 4 is a second diagrammatic sectional view through scooper housing 103 illustrating a secondary position 158 of movable member 153 as the member moves along path 154. FIG. 5 is a third diagrammatic sectional view through scooper housing 103 illustrating movable member 153 in tertiary position 160 along path 154.

To collect pet waste 104 for disposal, user 101 positions scooper housing 103 over pet waste 104, as shown in FIG. 3, and manipulates hand-operated actuator 107 (best viewed on FIG. 1) to produce a pivoting movement of movable member 153. Such pivoting movement of movable member 153 begins at the starting position 156 of FIG. 3 and ends at the tertiary position 160 of FIG. 5. When the base of scooper housing 103 is held in contact with ground surface 105, path 154 preferably extends along a sweeping arc passing generally between pet waste 104 and the ground surface 105. During such movement, the attached disposable liner 118 is preferably folded about pet waste 104 by movable member 153 of sheet-folder 152, as shown.

Movable member 153 preferably comprises a lead-edge portion 164 that is preferably positioned to advance along path 154 as movable member 153 pivots about rotational axis 162, as shown. In addition, movable member 153 preferably comprises an arcuate wall 166, preferably extending between lead-edge portion 164 and pivoting coupler assembly 109, as shown. The arcuate wall 166 of movable member 153 preferably comprises a generally concave inner surface 168, as shown, preferably forming a "scoop-like" structure (at least embodying herein wherein such at least one movable member comprises at least one scoop structured and arranged to assist scooping of the objects from the at least one ground surface; and such at least one scoop comprises at least one arcuate wall extending substantially between such at least one lead-edge portion and such at least one pivot joint). The scoop-like shape of arcuate wall 166 was found to promote the efficient collection of the pet waste 104 from ground surface 105 (See FIG. 6) as lead-edge portion 164 moved along path 154. Upon reading the teachings of this specification, those of ordinary skill in the art will now understand that, under appropriate circumstances, considering such issues as intended use, cost, user preference, etc., other scoop-like arrangements, such as, for example, square, triangular, and similar geometric shapes, half-spheres, complex shapes including free-form surfaces, etc., may suffice.

Figure 6A:
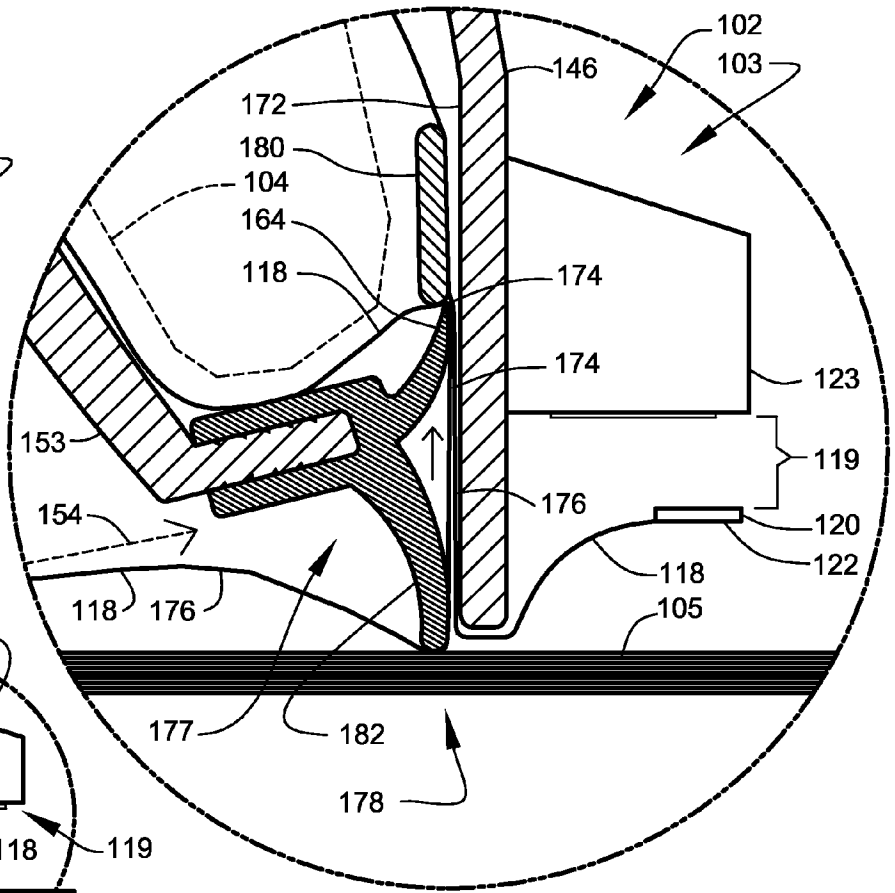
FIG. 6A is a partial sectional view depicting a region of FIG. 5, enlarged for magnification purposes, illustrating the sealing of a disposable liner about the objects.

FIG. 6A is a partial sectional view depicting a region of FIG. 5, enlarged for magnification purposes, illustrating the preferred sealing of disposable liner 118 about the pet waste 104. Lead-edge portion 164 is preferably adapted to engage disposable liner 118 during advancement of movable member 153 from starting position 156 to secondary position 158 (at least embodying herein wherein such at least one lead-edge portion comprises at least one sheet engager structured and arranged to engage the at least one substantially non-porous flexible sheet during such advancement along such at least one path). As lead-edge portion 164 sweeps along path 154 from secondary position 158 to tertiary position 160, disposable liner 118 is folded substantially about pet waste 104, as shown in FIG. 4 and FIG. 5 (at least embodying herein wherein the at least one substantially non-porous flexible sheet is folded substantially around the pet waste during such advancement of such at least one sheet engager along such at least one path). During the operation, disposable liner 118 is continuously positioned between lead-edge portion 164 and the pet waste 104, most preferably by the positioning action of sheet-holder 110 (at least embodying herein at least one sheet positioner structured and arranged to continuously position the at least one substantially non-porous flexible sheet substantially between such at least one lead-edge portion and the pet waste). During the folding process, the trailing (left hand) releasable retainer 119 (See FIG. 6) separates as disposable liner 118 is drawn away from the trailing support flange 123 as shown.

During collection, a cohesive seal 174 is preferably formed within disposable liner 118 substantially enclosing the pet waste 104 within the folded sheet. It is noted that disposable liner 118 preferably comprises a cohesive surface 176 adapted to form such a cohesive seal 174 when separate regions of disposable liner 118 are brought into contact. Cohesive surface 176 preferably comprises at least one material or structure adapted to form a cohesive seal 174 when separate regions of the bag surfaces are brought into contact and which have features for preventing premature sticking to a target surface during storage and positioning of the film. Preferred materials and structures of disposable liner 118 are discussed in a subsequent section of the present disclosure.

It is also preferred that sheet folder 152 comprise a seal-formation assister 177 to assist the formation of a continuous seal 174 around the waste material (at least embodying herein wherein such sheet folder means comprises seal-formation assister means for assisting the formation of at least one such cohesive seal substantially enclosing the objects within the at least one flexible non-porous sheet). Formation of such a continuous seal 174 is important to the elimination of the unpleasant smell and appearance of the waste.

The operation of seal-formation assister 177 initially utilizes lead-edge portion 164 to press the folded regions of disposable liner 118 against a firm backing surface, preferably the inner surface 172 of outer wall 146 (at least embodying herein wherein such at least one sheet backer comprises at least one interior surface of such at least one of such housing walls). As best illustrated in FIG. 5 and FIG. 6A, the path 154 of lead-edge portion 164 preferably intersects inner surface 172 (at least embodying herein wherein such at least one path intersects at least one of such housing walls). Thus, advancement of lead-edge portion 164 along path 154, to the tertiary position 160, preferably compresses the folded portion of disposable liner 118 between lead-edge portion 164 and inner surface 172, as shown. The compressive force developed between lead-edge portion 164 and inner surface 172 produces the preferred cohesive seal 174 between folded portions of disposable liner 118, as shown. To further increase the area of seal 174, seal-formation assister 177 further comprises a sheet lifter 178 adapted to lift the folded portions of disposable liner 118 in a generally vertical direction, as best illustrated in FIG. 6A.

Sheet lifter 178 is preferably structured and arranged to lift the folded portions of disposable liner 118 upwardly along inner surface 172, as shown (at least embodying herein at least one sheet lifter structured and arranged to lift such at least one folded portion upwardly along such at least one interior surface during such compression of such at least one folded portion between such at least one sheet engager and such at least one sheet backer wherein such lifting of such at least one folded portion by at least one sheet lifter assists the release of the at least one substantially non-porous flexible sheet from such at least one releasable retainer). The above-arrangement preferably produces cohesive contact between additional folded regions of disposable liner 118 located generally below lead-edge portion 164, as shown. Furthermore, disposable liner 118 is preferably equipped with a peripheral stiffener 180 that functions to stiffen the sheet along the contact point with lead-edge portion 164. The preferred incorporation of peripheral stiffener 180 within disposable liner 118 produces an especially robust seal 174 as the folded portions of disposable liner 118 are firmly compressed between lead-edge portion 164 and peripheral stiffener 180 by the upward force generated by sheet lifter 178, as shown (at least embodying herein wherein such at least one downwardly projecting sweeping member applies at least one upward force on such at least one sheet engager during contact with the at least one ground surface).

Sheet lifter 178 preferably comprises a downwardly-projecting sweeping member 182 coupled to movable member 153 below lead-edge portion 164, as shown. Sweeping member 182 is preferably structured and arranged to sweep across ground surface 105 as movable member 153 moves along path 154 (at least embodying herein coupled to such at least one movable member, at least one downwardly-projecting sweeper structured and arranged to sweep across the at least one ground surface as such at least one movable member moves along such at least one path). As sweeping member 182 contacts the ground surface, the member applies an opposing generally upward force on lead-edge portion 164.

Applicant has found superior sealing results were produced by constructing both lead-edge portion 164 and sweeping member 182 from at least one substantially resilient material. For convenience, both lead-edge portion 164 and sweeping member 182 are preferably formed as a single unit, as shown. The combined single unit member preferably comprises a molded or alternately preferably an extruded synthetic rubber bar, as shown. The combined bar is preferably attached to the lower edge of movable member 153 by mechanical engagement and/or bonding, as shown.

As disposable liner 118 (now substantially sealed) continues to be pushed further into scooper housing 103, disposable liner 118 is drawn away from the peripheral attachments to scooper housing 103 decoupling both releasable retainers 119. The above-arrangement preferably allows disposable liner 118 to fall free from scooper housing 103 when movable member 153 is allowed to return to starting position 156. Once released, the now-sealed disposable liner 118 is easily collected and removed for disposal, or more preferably, released and deposited directly into a waste receptacle (the above arrangements at least embody herein at least one releaser structured and arranged to release the at least one substantially non-porous flexible sheet from such at least one sheet holder on formation of such at least one such cohesive seal; wherein such at least one releaser comprises at least one sheet lifter structured and arranged to lift such at least one folded portion upwardly along such at least one interior surface during such compression of such at least one folded portion between such at least one sheet engager and such at least one sheet backer; and wherein such lifting of such at least one folded portion by at least one sheet lifter assists the release of the at least one substantially non-porous flexible sheet from such at least one releasable retainer).

Figure 6B:
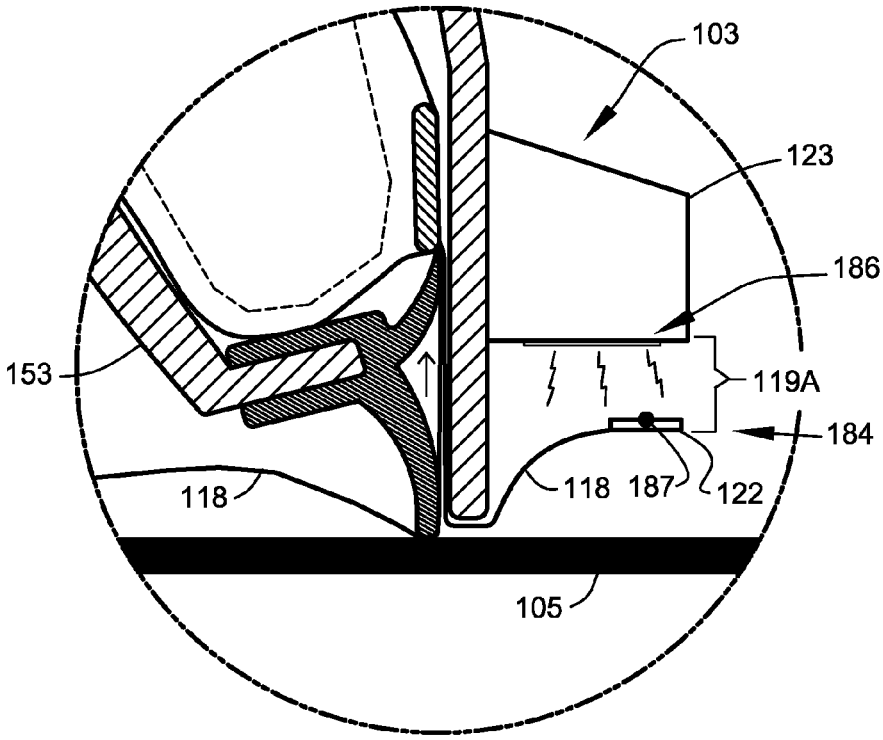
FIG. 6B is a partial sectional view depicting a region of FIG. 5, enlarged for magnification purposes, illustrating a magnetic releasable attacher for holding a disposable liner to the pet-debris scooper.

Releasable retainers 119 provide an easy "hands free" way to detach the waste-filled disposable liner from the scooping device. Releasable retainers 119 of pet-debris scooper system 100 preferably comprise one of several preferred types. In a first preferred embodiment, disposable liner 118 is retained to scooper housing 103 by magnetic coupling, as illustrated in FIG. 6B. In this preferred embodiment (identified herein as releasable retainer 119A), one or more magnetic-field producers 186 are preferably coupled to support flanges 123 of scooper housing 103, as shown. Adhering strip 122 of disposable liner 118 is preferably constructed to comprise a magnetic material 184 having a magnetic attraction to magnetic-field producers 186. Disposable liner 118 is preferably retained on scooper housing 103 by the magnetic coupling of magnetic material 184 and magnetic-field producers 186.

In a highly preferred arrangement, adhering strip 122 comprises an iron-containing metallic wire 187 firmly joined to disposable liner 118. Wire 187 preferably extends across substantially a full width W1 of adhering strip 122 (see FIG. 13). Magnetic-field producer 186 of releasable retainer 119A preferably comprises at least one permanent magnet. A permanent magnet suitable for use as magnetic-field producer 186 preferably includes a flexible sheet-type magnet bonded to the underside of each support flange 123, as shown. The permanent magnet preferably extends across width of support flange 123 substantially equaling width W1 of adhering strip 122.

Figure 6C:
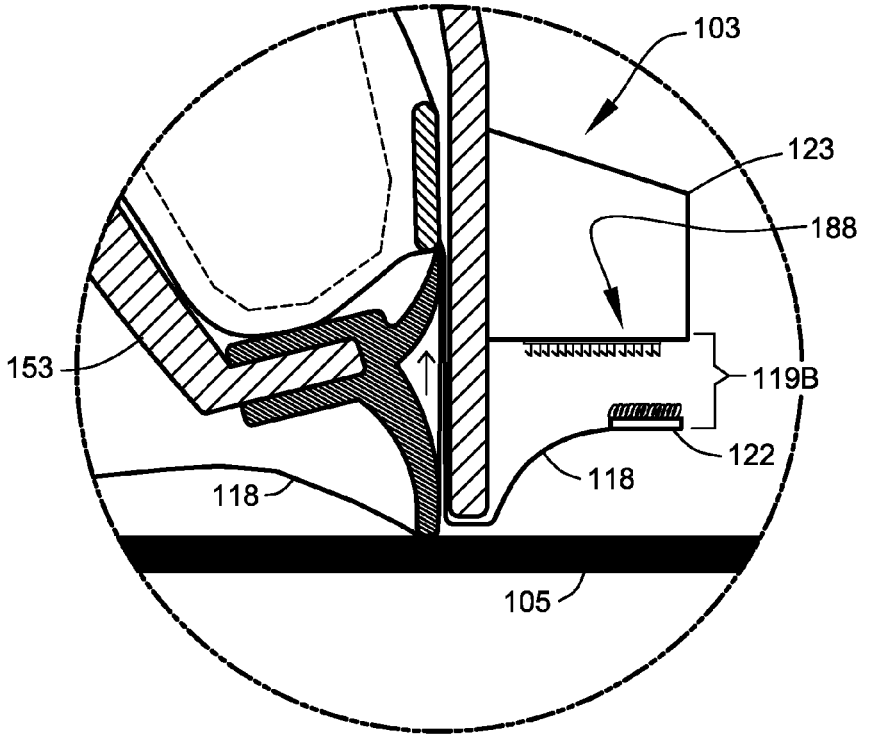
FIG. 6C is a partial sectional view depicting a region of FIG. 5, enlarged for magnification purposes, illustrating a Hook-and-loop releasable attacher for holding a disposable liner to the pet-debris scooper.

In a second preferred embodiment of releasable retainer 119 (identified herein as releasable retainer 119B), disposable liner 118 is preferably retained to scooper housing 103 by an arrangement of two-part hook-and-loop fasteners 188. More specifically, both support flanges 123 of scooper housing 103 are preferably fitted with a first portion of two-part hook-and-loop fastener 188 and both adhering strips 122 of releasable retainer 119B preferably comprises a second portion of two-part hook-and-loop fastener 188, as shown in FIG. 6C. Disposable liner 118 is preferably held adjacent scooper housing 103 by removably coupling the first and second portions of two-part hook-and-loop fastener 188. Upon reading this specification, those with ordinary skill in the art will now appreciate that, under appropriate circumstances, considering such issues as cost, user preference, etc., other retainer arrangements such as, for example, suction cups, non-permanent adhesives, spring-type clips, static-electricity, friction-based adhesion, etc., may suffice.

Figure 7:
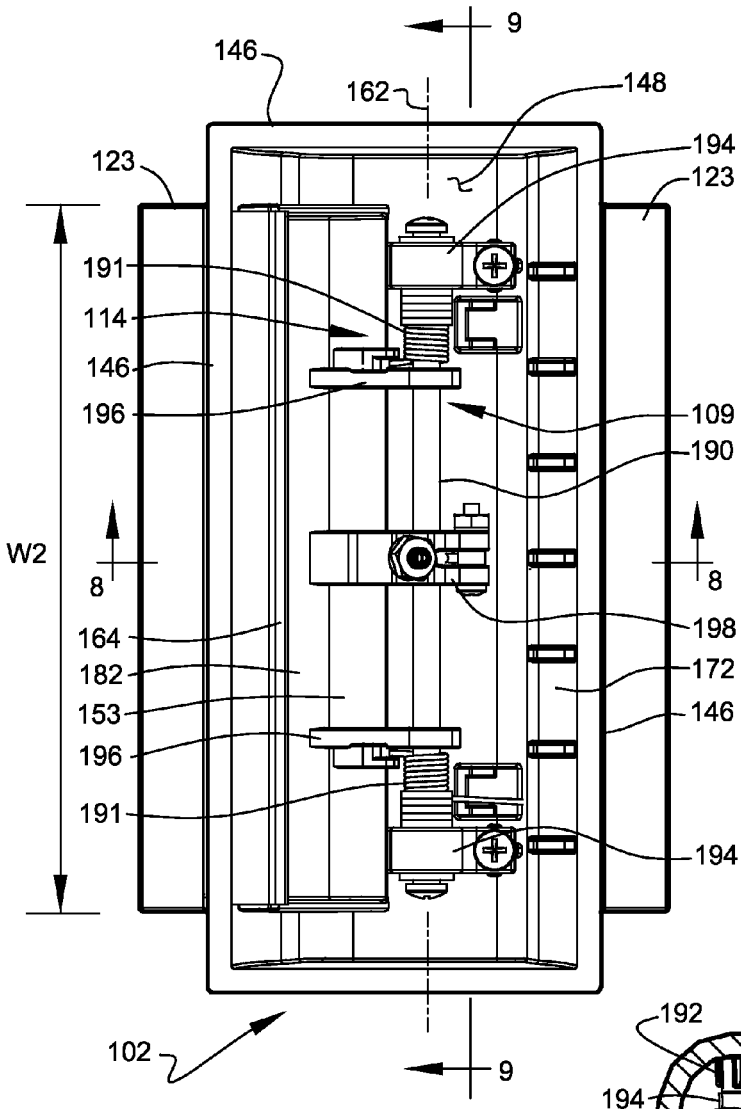
FIG. 7 is a bottom view of the pet-debris scooper of FIG. 1.
Figure 8:
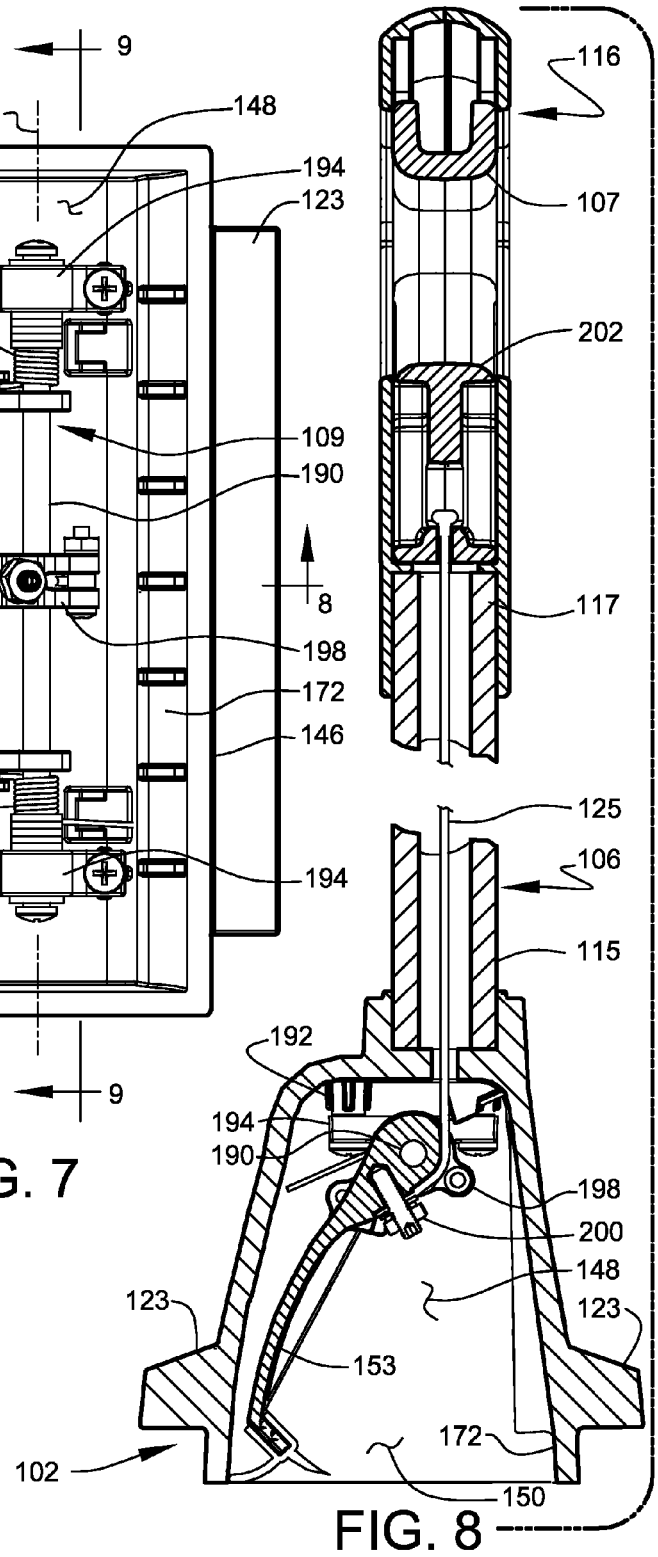
FIG. 8 is a sectional view through the section 8-8 of FIG. 7.
Figure 9:
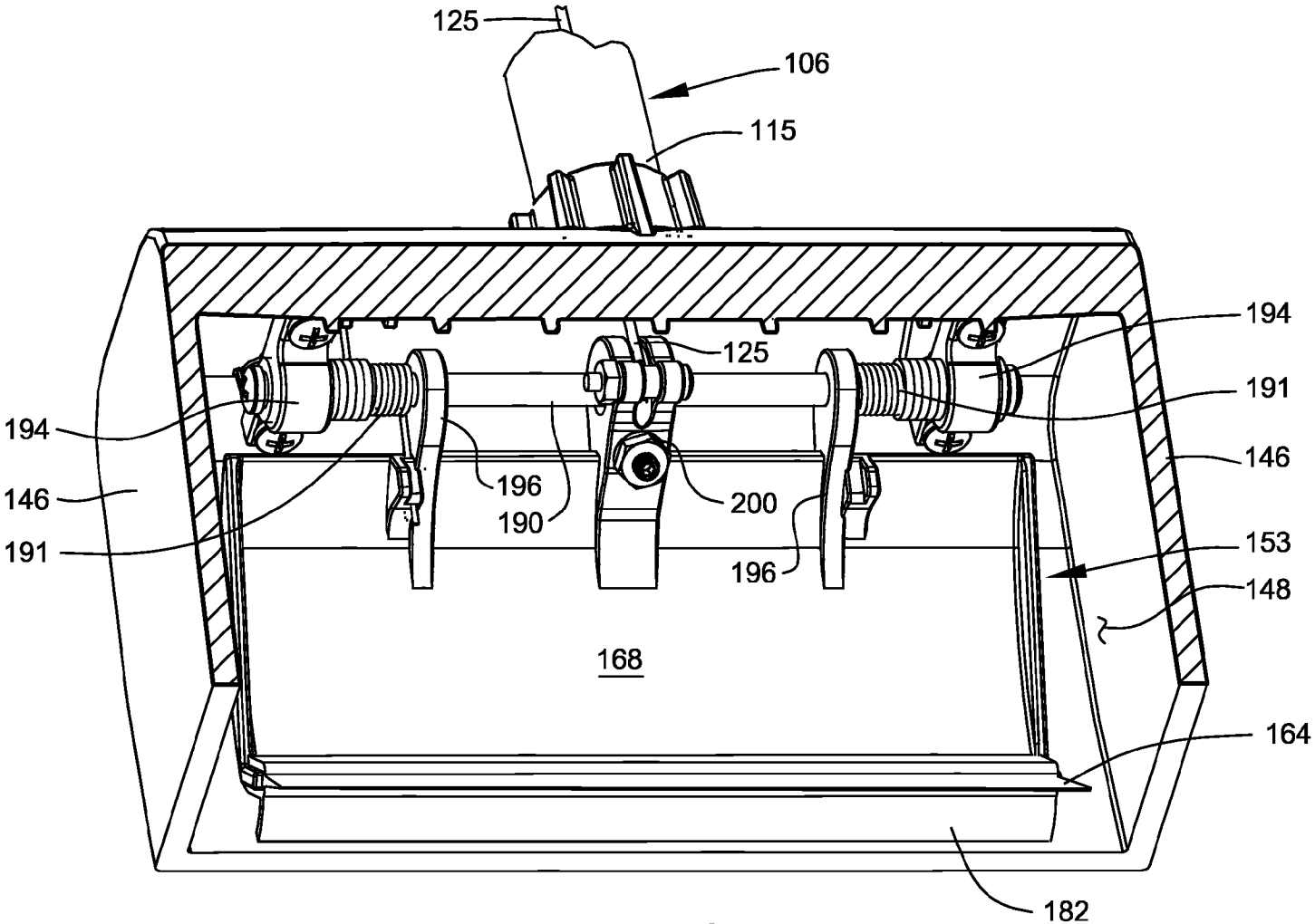
FIG. 9 is a perspective view through the section 9-9 of FIG. 7.

FIG. 7 is a bottom view of pet-debris scooper 102 further illustrating the preferred arrangements of sheet-holder 110 and sheet-folder 152. FIG. 8 is a sectional view through the section 8-8 of FIG. 7. FIG. 9 is a perspective view through the section 9-9 of FIG. 7. Reference is now made to FIG. 7 through FIG. 9 with continued reference to the prior described figures.

The bottom view of FIG. 7 further illustrates the preferred arrangements of movable member 153 and pivot coupler assembly 109. Pivot coupler assembly 109 preferably comprises a single cylindrical shaft 190 mounted to a set of support bosses 192 projecting from the underside of internal compartment 148, as shown. Cylindrical shaft 190 is preferably retained to support bosses 192 by set of removable caps 194, as shown. Movable member 153 preferably comprises a set of aperture-containing flanges 196 adapted to engage cylindrical shaft 190, as shown.

Movable member 153 is preferably biased toward starting position 156, preferably by the application of spring tension or the application of a restoring force by a similar tensioning mechanism, diagrammatically illustrated as biasing element 114, as shown. Biasing element 114 preferably comprises a set of cylindrical springs 191 situated over cylindrical shaft 190, each one comprising in portions respectively coupled to support bosses 192 and aperture-containing flanges 196, as shown (at least embodying herein at least one spring biaser structured and arranged to spring bias such at least one sheet engager to at least one position separated from such at least one sheet backer). Upon reading the teachings of this specification, those of ordinary skill in the art will now understand that, under appropriate circumstances, considering such issues as intended use, design preference, etc., other biasing arrangements, such as, for example, biasing a scoop to a normally closed position, using a battery-powered motor to operate the scoop, etc., may suffice.

Lead-edge portion 164 and sweeping member 182 are visible in the bottom view of FIG. 7 preferably joined to the distal edge of movable member 153. Both lead-edge portion 164 and sweeping member 182 preferably extend substantially along a width W2 of movable member 153, as shown.

In the preferred embodiments of the present system, hand-operated actuator 107 preferably comprises a tensioning member 125 adapted to apply a pulling force to at least one cam-like lever arm 198 rigidly coupled to movable member 153, as shown. Tensioning member 125 preferably comprises a flexible cable, preferably extending between gripping-portion 116 and lever arm 198, as shown. The lower end of tensioning member 125 is preferably coupled to lever arm 198 at an adjustable coupler 200, as shown. The upper end of tensioning member 125 is preferably coupled with a vertically translatable hand grip 202 of gripping-portion 116, as shown.

Figure 10:
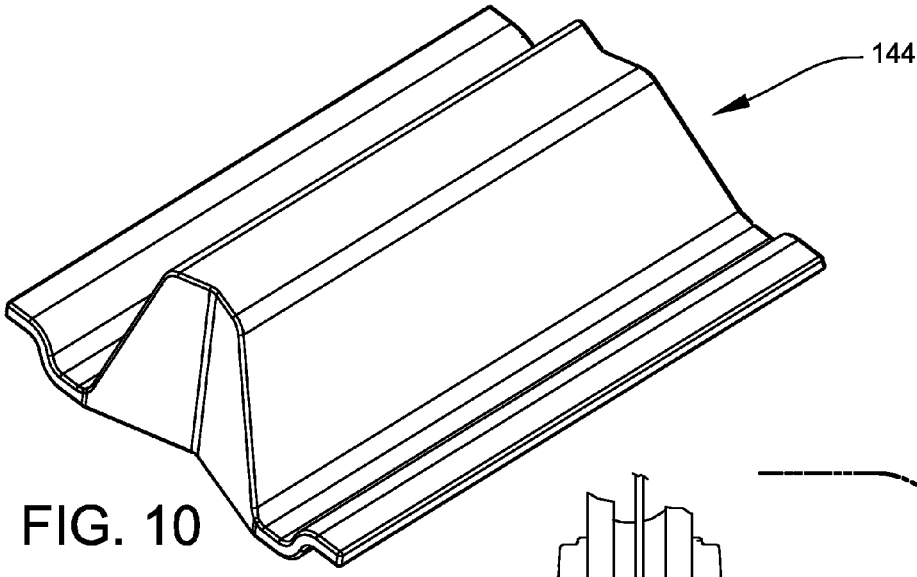
FIG. 10 is a perspective view of a disposable-liner dispenser according to a preferred embodiment of the present invention.
Figure 11:
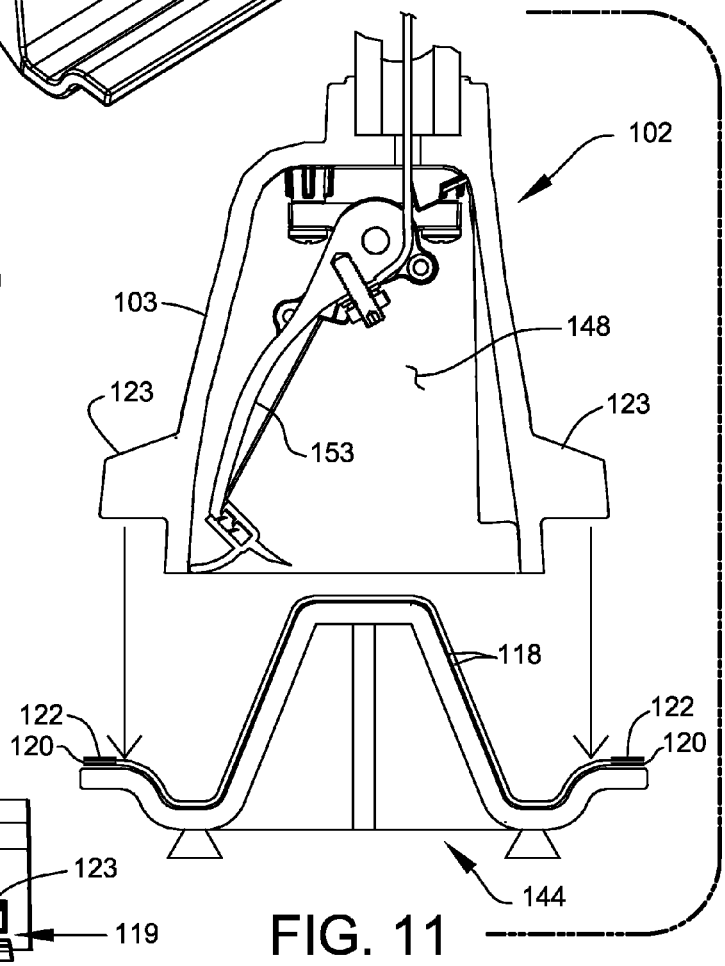
FIG. 11 is a diagrammatic sectional view illustrating the dispensing of a disposable liner on the pet-debris scooper of FIG. 1.
Figure 12:
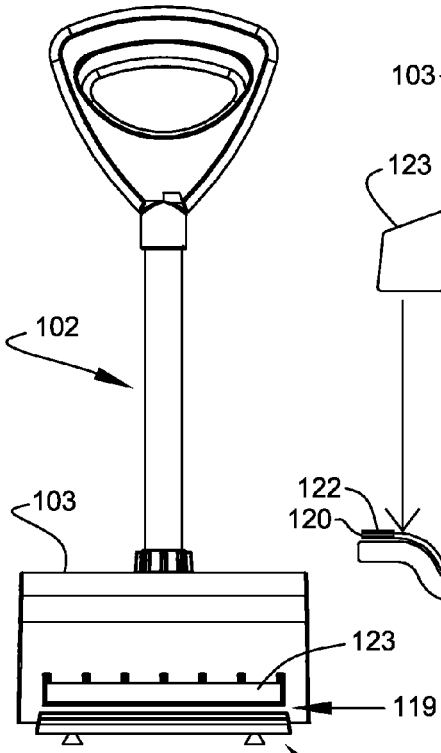
FIG. 12 is a side view of the pet-debris scooper of FIG. 1 engaging the disposable-liner dispenser of FIG. 10 according to a preferred embodiment of the present invention.
Figure 13:
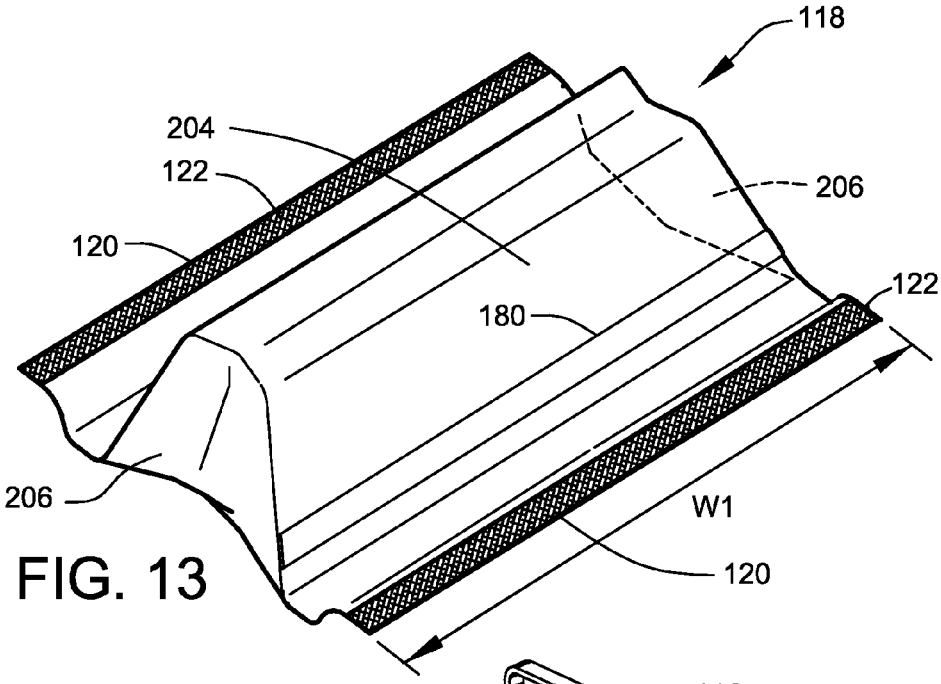
FIG. 13 is a perspective view of a disposable-liner according to another preferred embodiment of the present invention.

Pet-debris scooper 102, on discharging the sealed disposable liner 118, is ready for the fitting of a new disposable liner 118. FIG. 10 is a perspective view of a disposable-liner dispenser 144 used to apply a new disposable liner 118 on pet-debris scooper 102, according to a preferred embodiment of the present invention. FIG. 11 is a diagrammatic sectional view illustrating the dispensing of a new disposable liner 118 on pet-debris scooper 102 of FIG. 1. FIG. 12 is a side view of pet-debris scooper 102 engaging disposable-liner dispenser 144 of FIG. 10. FIG. 13 is a perspective view of a single disposable-liner 118 according to a preferred embodiment of the present invention.

Disposable-liner dispenser 144 is preferably adapted to apply, in essentially a "hands free" manner, a single disposable liner 118 to pet-debris scooper 102 by a simple press-and-release movement.

A second important function of disposable-liner dispenser 144 is that of a holder to provide proper positioning and alignment of pet-debris scooper 102 within disposable-liner dispenser 144 during the application of a disposable liner 118. A third important function of disposable-liner dispenser 144 is that of a refillable holder to hold a plurality of disposable liners 118 (enabling multiple applications of single liners). Yet another function of disposable-liner dispenser 144 is that of a holder providing convenient vertical storage of pet-debris scooper 102 between uses, as shown in FIG. 12. Preferably, disposable-liner dispenser 144 is operated without the use of electrically powered components. Upon reading the teachings of this specification, those of ordinary skill in the art will now understand that, under appropriate circumstances, considering such issues as intended use, cost, etc., other actuation arrangements, such as, for example, the use of electrically powered components, etc., may suffice. Preferably, disposable-liner dispenser 144 adapted to rest on a generally horizontal support surface, most preferably a floor surface. Upon reading the teachings of this specification, those of ordinary skill in the art will now understand that, under appropriate circumstances, considering such issues as intended use, size of unit, user preference, etc., other support arrangements, such as, for example, wall mounts, vehicle storage mounts, etc., may suffice. When pet-debris scooper 102 (without a liner attached), is placed onto disposable-liner dispenser 144, one disposable liner 118 attaches itself to support flanges 123 of scooper housing 103 by means of releasable retainers 119, more specifically, by adhering strips 122 located along the peripheral edges 120 of disposable liner 118, as shown. It is noted that disposable-liner dispenser 144 comprises a shape closely matching that of disposable liner 118. For user convenience, disposable-liner dispenser 144 is adapted to support a stacked plurality of disposable liners 118, as shown in FIG. 11.

Disposable liner 118 preferably comprises a pocket-like configuration having a generally U-shaped main wall 204 bounded by opposing sidewalls 206, as shown. Preferred materials suitable for use in the fabrication of disposable liner 118 include self-sealing materials comprising flexible films comprising at least one cohesive surface adapted to form a cohesive seal when separate regions of such cohesive surface are brought into contact and which have features for preventing premature sticking to a target surface during storage and positioning of the film. Films suitable for use in the fabrication of disposable liner 118 include materials produced by The Procter & Gamble Company of Cincinnati, Ohio under the "GRIPTEX™" brand. Upon reading this specification, those with ordinary skill in the art will now appreciate that, under appropriate circumstances, considering such issues as cost, user preference, etc., other sealing arrangements such as, for example, hook and loop fasteners, mating male and female ridges, interlocking tabs, etc., may suffice.

Figure 14:
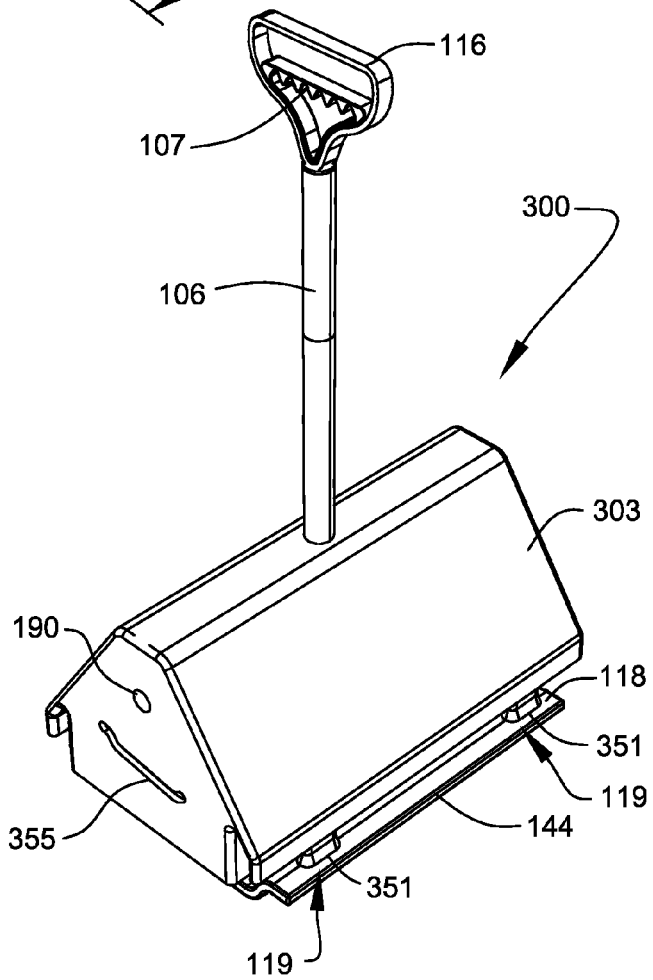
FIG. 14 is a perspective view illustrating an alternate pet-debris scooper, according to another preferred embodiment of the present invention.
Figure 15:
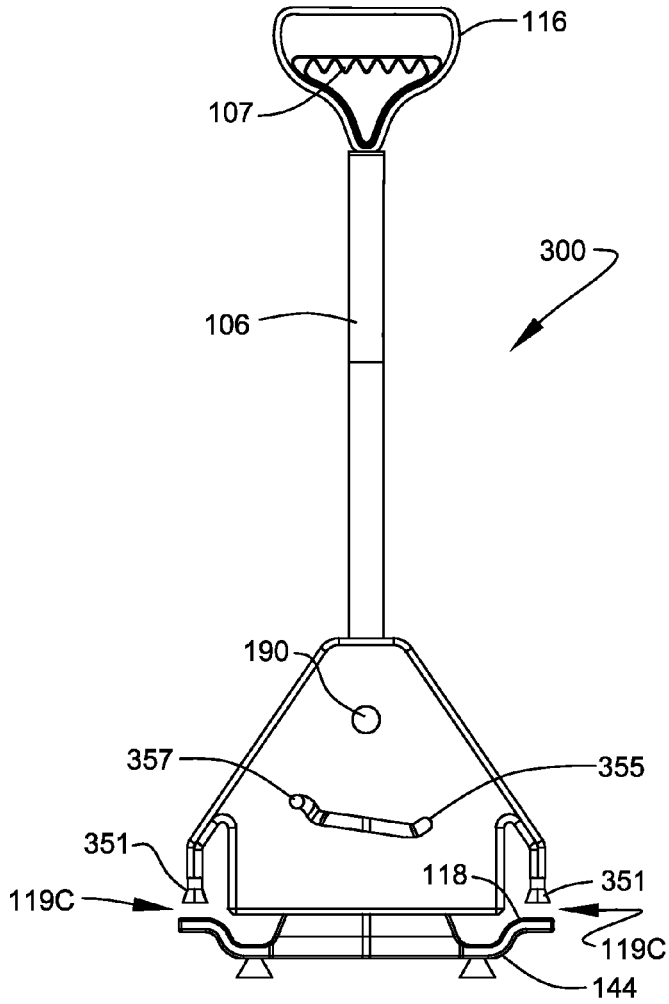
FIG. 15 is a side view illustrating the alternate pet-debris scooper engaging the disposable-liner dispenser of FIG. 10, according to the preferred embodiment of FIG. 14.
Figure 16:
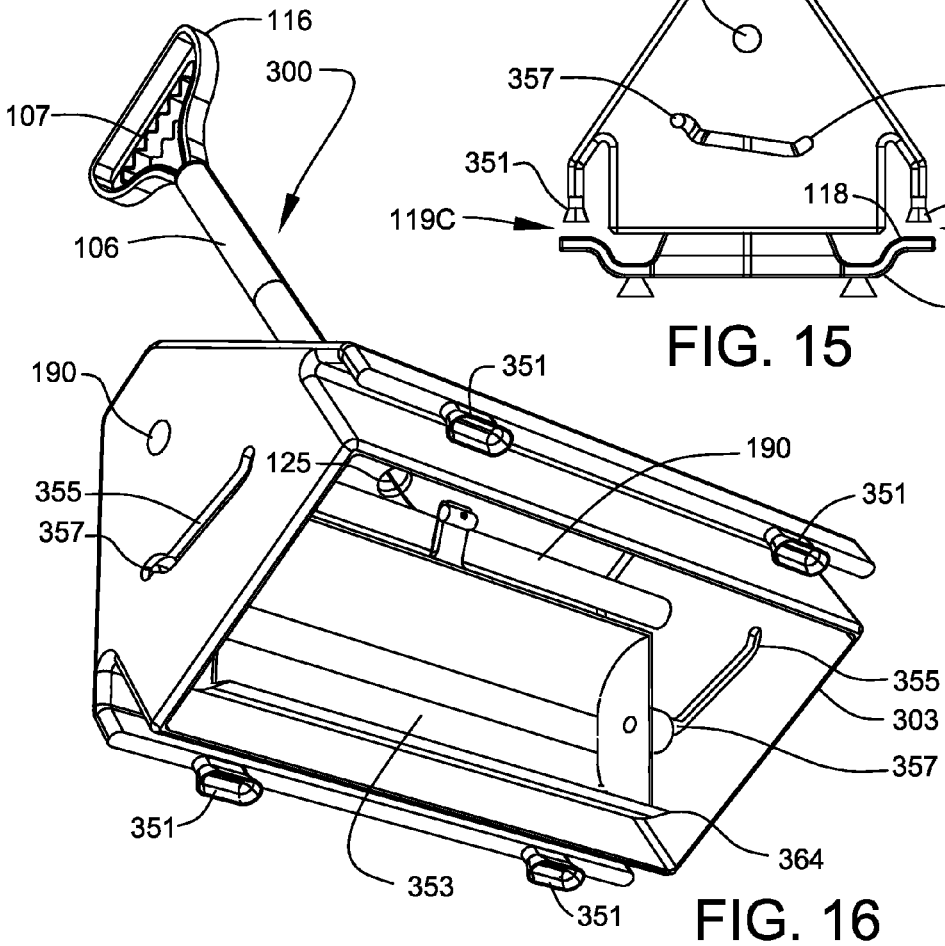
FIG. 16 is a bottom perspective view illustrating a preferred arrangement of operable internal components, according to the preferred embodiment of FIG. 14.
Figure 17:
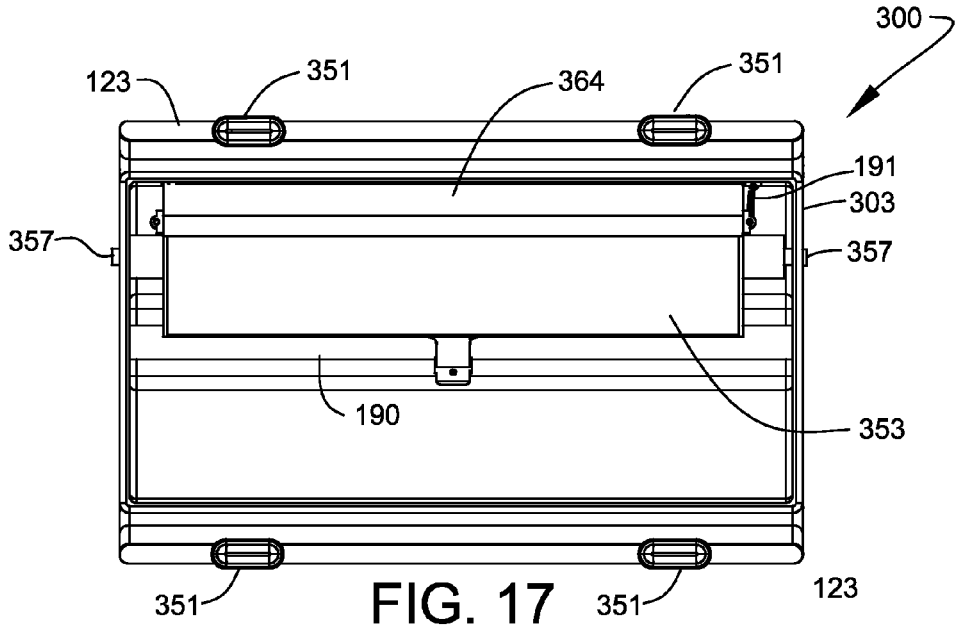
FIG. 17 is a bottom view of the alternate pet-debris scooper of FIG. 14 according to the preferred embodiment of FIG. 14.
Figure 18:
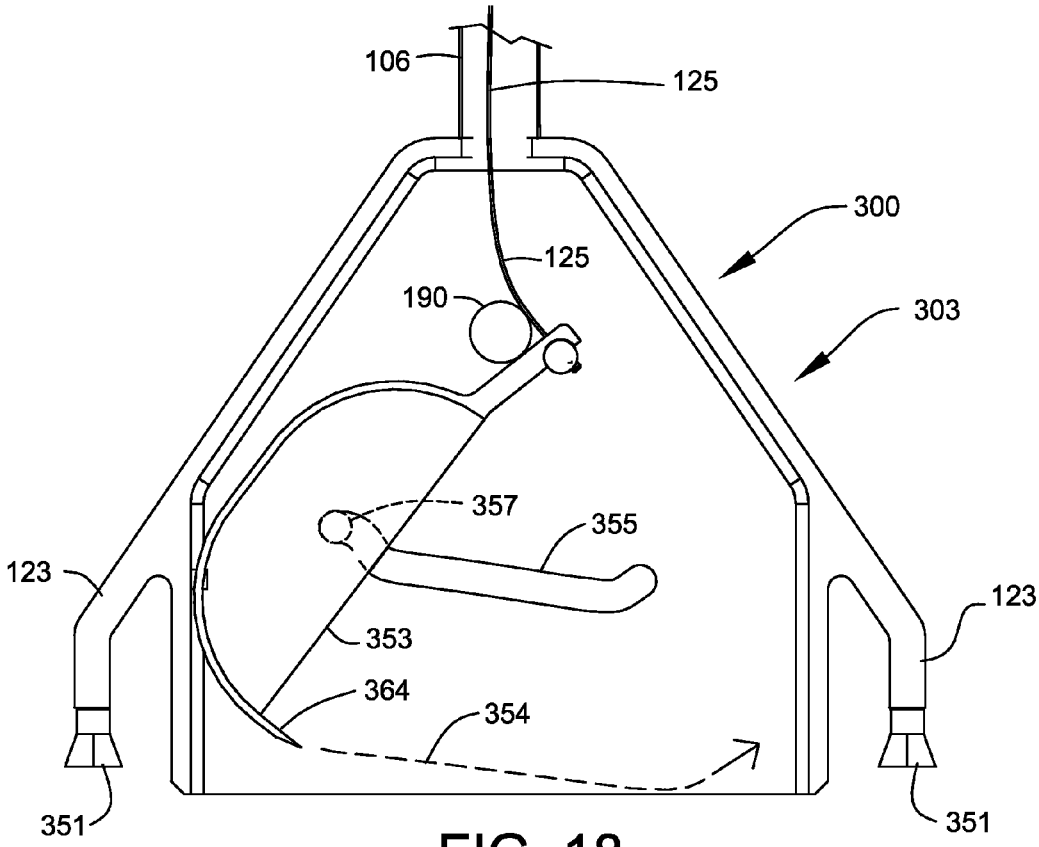
FIG. 18 is a sectional view through the section 18-18 of FIG. 17.

FIG. 14 is a perspective view illustrating an alternate pet-debris scooper 300, according to another preferred embodiment of the present invention. FIG. 15 is a side view illustrating alternate pet-debris scooper 300 engaging disposable-liner dispenser 144 of FIG. 10, according to the preferred embodiment of FIG. 14. FIG. 16 is a bottom perspective view illustrating a preferred arrangement of operable internal components, according to alternate pet-debris scooper 300 of FIG. 14. FIG. 17 is a bottom view of the alternate pet-debris scooper 300 of FIG. 14. FIG. 18 is a sectional view through the section 18-18 of FIG. 17. It is noted that alternate pet-debris scooper 300 comprises physical arrangements substantially similar to the preferred embodiment of FIG. 1; thus, only the differences between alternate pet-debris scooper 300 and the prior embodiment will be elaborated upon.

The principal difference between alternate pet-debris scooper 300 and the prior embodiment is in the mounting of the movable member, preferably identified herein as movable member 353. Alternate pet-debris scooper 300 preferably eliminates sweeping member 182 in favor of a set of guide tracks 355 structured and arranged to guide movable member 353 along a controlled path 354. Each side of movable member 353 preferably comprises a projection 357 adapted to movably engage a respective guide track 355 located on each side of alternate scooper housing 303, as shown. Aperture-containing flanges 196 have been eliminated from movable member 353 to permit vertical translation of movable member 353 relative to cylindrical shaft 190.

Manipulation of hand-operated actuator 107 by user 101 preferably produces a pivoting movement of movable member 353 about cylindrical shaft 190. As movable member 353 pivots about cylindrical shaft 190, the movement path of the member is preferably defined by guide tracks 355. Past starting position 156, movable member 353 is initially lowered to place alternate lead-edge portion 364 at a level generally below the pet waste 104. Guide tracks 355 subsequently moves movable member 353 forward in a generally downward sweep to both scoop the pet waste 104 from the ground surface and fold disposable liner 118 about the waste. Guide tracks 355 preferably lift movable member 353 as alternate lead-edge portion 364 approaches the tertiary position of modified path 354. As in the prior embodiment, the final upward movement assists in sealing the pet waste 104 within disposable liner 118.

A secondary difference between alternate pet-debris scooper 300 and the prior embodiment is the use of releasable retainers operating on the principle of differential pressure. In such a third preferred embodiment of the releasable retainer, disposable liner 118 is preferably retained to scooper housing 103 by generating low atmospheric pressure at releasable retainer (relative to the surrounding atmospheric pressure). In this preferred embodiment (identified herein as releasable retainer 119C), one or more suction cups 351 are preferably coupled to support flanges 323 of alternate scooper housing 303, as shown (at least embodying herein at least one suction cup structured and arranged to releasably retain the at least one substantially non-porous flexible sheet on such at least one sheet holder substantially by differential pressure).

Both pet-debris scooper 102 and alternate pet-debris scooper 300 are preferably constructed from at least one durable and lightweight material, preferably molded plastic. For durability, cylindrical shaft 190 along with the removable mechanical fasteners may be constructed of a metallic material. Upon reading this specification, those with ordinary skill in the art will now appreciate that, under appropriate circumstances, considering such issues as cost, user preference, etc., other material arrangements such as, for example, aluminum, sheet metal, wood, etc., may suffice.

Figure 19:
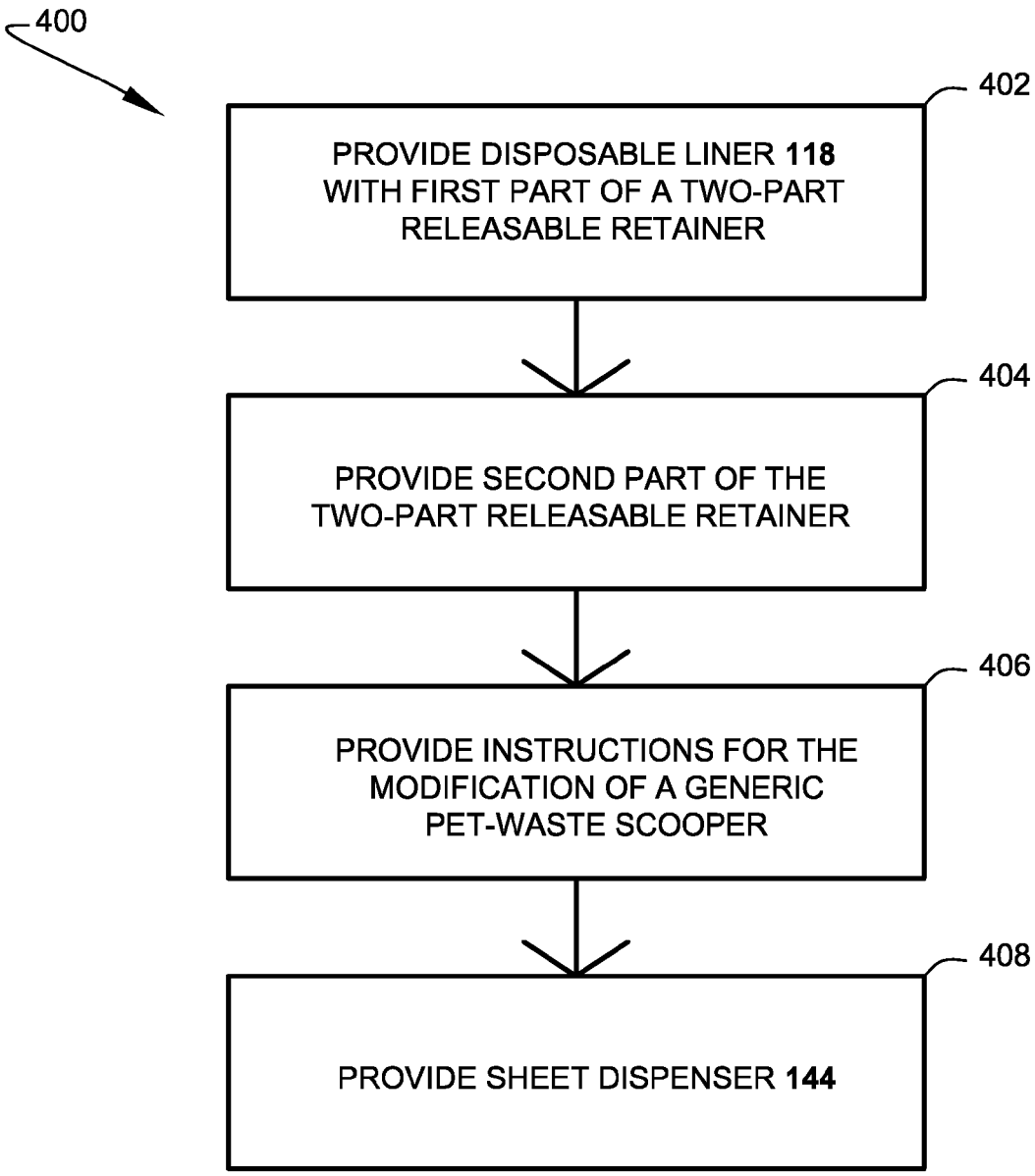
FIG. 19 is a flow diagram illustrating a method related to the more efficient and hygienic disposal of pet waste through the modification of a generic manually-operated pet-waste scooper to receive a disposable-liner.

Pet-debris scooper system 100 further comprises method 400 related to the more efficient and hygienic disposal of pet waste 104 through the modification of a generic manually-operated pet-waste scooper. It is sometimes preferred to use disposable liners 118 with a generic pet-waste scooper of a type equipped with a movable jaw, such as, existing "clam-shell" type scoopers. For example, user 101 may currently own such a scooper and may wish to improve its functionality rather than seek a full replacement. By adapting Applicant's disposable liners 118 to such a generic pet-waste scooper, the usefulness of the device is significantly improved. FIG. 19 is a flow diagram illustrating method 400 related to the more efficient and hygienic disposal of pet waste through the modification of such a generic manually-operated pet-waste scooper to receive disposable-liners 118.

In the initial preferred step 402, the above-described disposable liners 118 are provided for use in the modification of generic pet-waste scoopers. As previously noted, disposable liners 118 preferably comprises at least one cohesive surface adapted to form at least one cohesive seal when separate regions of the cohesive surface are brought into contact. In addition, disposable liners 118 preferably comprise a first part of a two-part releasable retainer 119. Such releasable retainer 119 may preferably comprise a hook and loop fastener, magnetic coupler, or other means for releasably retaining a disposable liners 118 to such generic pet-waste scooper.

In subsequent preferred step 404, the second part of the two-part releasable retainer 119 is provided. Next, as indicated in preferred step 406, at least one set of instructions are provided to assist the modification of the generic pet-waste scooper to comprise the second part of such two-part coupler. In a preferred modification, a second part of hook-and-loop fastener 188 is adhered to an outer surface of the generic pet-waste scooper. Thus, such manually-operated pet-waste scooper, comprising the second part of releasable retainer 119, is structured and arranged to removably receive a disposable liners 118. Although production of a continuous seal is less likely when using a modified scooper, Applicant has found that such a modification significantly improves the overall functionality and usefulness of such generic scoopers.

Method 400 further comprises the additional step 408 of providing a sheet dispenser 144 to assist dispensing disposable liners 118 onto the modified pet-waste scooper. Upon reading this specification, those with ordinary skill in the art will now appreciate that, under appropriate circumstances, considering such issues as cost, user preference, etc., other modification and apparatus arrangements such as, for example, providing over-mountable members to improve the functionality of the generic scooper, providing scooper-specific dispensers, providing scooper-specific disposable liners, selling of modifications as a kit, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system related to the collecting of objects by a user using at least one substantially non-porous flexible sheet comprising at least one cohesive surface adapted to form at least one cohesive seal when separate regions of the at least one cohesive surface are brought into contact, said system comprising:

a) at least one sheet holder structured and arranged to hold the at least one substantially non-porous flexible sheet;

b) at least one user grip structured and arranged to assist gripping of said at least one sheet holder by the user;

c) at least one sheet folder structured and arranged to fold the at least one substantially non-porous flexible sheet about the objects;

d) at least one seal-formation assister structured and arranged to assist the formation of the at least one cohesive seal substantially enclosing the objects within the at least one flexible non-porous sheet; and e) at least one manually-operated actuator structured and arranged to assist manual actuation of said at least one sheet folder and said at least one seal-formation assister by the user without direct contact of the at least one substantially non-porous flexible sheet by the user;

f) wherein said at least one sheet folder comprises:

i) at least one movable member structured and arranged to be movable between the objects and at least one ground surface supporting the objects, and ii) at least one pivot joint structured and arranged to pivotally join said at least one movable member with said at least one sheet holder about at least one rotational axis; and g) wherein said at least one sheet holder comprises:

i) at least one releasable retainer structured and arranged to releasably retain the at least one substantially non-porous flexible sheet on said at least one sheet holder prior to formation of the at least one cohesive seal, and ii) at least one releaser structured and arranged to release the at least one substantially non-porous flexible sheet from said at least one sheet holder on formation of the at least one cohesive seal substantially enclosing the objects within the at least one flexible non-porous sheet.

2. The system according to claim 1, wherein said at least one releasable retainer comprises at least one suction cup structured and arranged to releasably retain the at least one substantially non-porous flexible sheet on said at least one sheet holder substantially by differential pressure.

3. The system according to claim 1, wherein:

a) said at least one movable member comprises at least one lead-edge portion structured and arranged to movably advance along at least one path extending about such at least one rotational axis;

b) said at least one sheet holder further comprises at least one sheet positioner structured and arranged to continuously position the at least one substantially non-porous flexible sheet substantially between said at least one lead-edge portion and the objects;

c) said at least one lead-edge portion comprises at least one sheet engager structured and arranged to engage the at least one substantially non-porous flexible sheet during such advancement along such at least one path; and d) the at least one substantially non-porous flexible sheet is folded substantially around the objects during such advancement of said at least one sheet engager along such at least one path.

4. The system according to claim 3, wherein said at least one seal-formation assister comprises:

a) intersecting such at least one path of said at least one sheet engager, at least one sheet backer structured and arranged to provide stable backing of at least one folded portion of the at least one substantially non-porous flexible sheet during such engagement with said at least one sheet engager;

b) wherein such advancement of said at least one sheet engager such at least one path compresses such at least one folded portion between said at least one sheet engager and said at least one sheet backer; and c) wherein such compression forms the at least one cohesive seal.

5. The system according to claim 4, wherein said at least one sheet engager comprises at least one substantially resilient material extending substantially along a width of said at least one lead-edge portion.

6. The system according to claim 4, wherein said at least one sheet holder further comprises:

a) at least one housing comprising at least one housing interior and at least one open bottom portion;

b) wherein said at least one housing comprises at least one arrangement of housing walls structured and arranged to substantially surround said at least one housing interior;

c) wherein such at least one path intersects at least one of said housing walls; and d) wherein said at least one sheet backer comprises at least one interior surface of such at least one of said housing walls.

7. The system according to claim 6, wherein said at least one releaser comprises:

a) at least one sheet lifter structured and arranged to lift such at least one folded portion upwardly along said at least one interior surface during such compression of such at least one folded portion between said at least one sheet engager and said at least one sheet backer;

b) wherein such lifting of such at least one folded portion by at least one sheet lifter assists the release of the at least one substantially non-porous flexible sheet from said at least one releasable retainer.

8. The system according to claim 7, wherein said at least one sheet lifter comprises:

a) coupled to said at least one movable member, at least one downwardly-projecting sweeper structured and arranged to sweep across the at least one ground surface as said at least one movable member moves along such at least one path;

b) wherein said at least one downwardly projecting sweeping member comprises at least one substantially resilient material extending substantially along a width of said at least one lead-edge portion; and c) wherein said at least one downwardly projecting sweeping member applies at least one upward force on said at least one sheet engager during contact with the at least one ground surface.

9. The system according to claim 7, further comprising at least one biaser structured and arranged to bias said at least one sheet engager to at least one position separated from said at least one sheet backer.

10. The system according to claim 7, wherein:

a) said at least one movable member comprises at least one scoop structured and arranged to assist scooping of the objects from the at least one ground surface; and b) said at least one scoop comprises at least one arcuate wall extending substantially between said at least one lead-edge portion and said at least one pivot joint.

11. The system according to claim 3, further comprising such at least one substantially non-porous flexible sheet.

12. The system according to claim 11, wherein said at least one releasable retainer comprises:

a) coupled with said at least one substantially non-porous flexible sheet, at least one magnetic material comprising a magnetic attraction to at least one magnetic-field producer; and b) coupled with said at least one sheet holder, such at least one magnetic-field producer;

c) wherein said at least one substantially non-porous flexible sheet is retained on said at least one sheet holder by at least one releasable magnetic coupling between said at least one magnetic material and said at least one magnetic-field producer.

13. The system according to claim 12, wherein:

a) said at least one magnetic material substantially comprises at least one ferrometallic wire; and b) said at least one magnetic-field producer at least one permanent magnet.

14. The system according to claim 11, wherein said at least one releasable retainer comprises:

a) coupled with said at least one sheet holder, at least one first portion of at least one two-part hook-and-loop fastener; and b) coupled with said at least one substantially non-porous flexible sheet, at least one second portion of at least one two-part hook-and-loop fastener;

c) wherein the at least one substantially non-porous flexible sheet is held adjacent said at least one sheet holder by removably coupling said at least one first portion and said at least one second portion of said at least one two-part hook-and-loop fastener.

15. The system according to claim 11, wherein said at least one substantially non-porous flexible sheet further comprises:

a) at least one peripheral stiffener structured and arranged to stiffen said at least one substantially non-porous flexible sheet along at least one contact point with said at least one sheet engager;

b) wherein such stiffening assist in the formation of the at least one cohesive seal.

16. The system according to claim 11, further comprising at least one sheet dispenser structured and arranged to assist dispensing the at least one substantially non-porous flexible sheet onto said at least one sheet holder without direct contact of the at least one substantially non-porous flexible sheet by the user.

17. The system according to claim 1, further comprising at least one elongated handle having at least one first handle end coupled to said at least one sheet holder and at least one second handle end coupled to said at least one user grip.

18. A system related to the collecting of objects by a user using at least one substantially non-porous flexible sheet comprising at least one cohesive surface adapted to form at least one cohesive seal when separate regions of the at least one cohesive surface are brought into contact, said system comprising:

a) sheet holding means for holding the at least one substantially non-porous flexible sheet;

b) user gripping means for assisting gripping of said sheet holding means by the user;

c) sheet folding means for folding the at least one substantially non-porous flexible sheet about the objects; and d) manually-operated actuating means for assisting manual actuation of said sheet folding means without direct contact of the at least one substantially non-porous flexible sheet by the user;

e) wherein said sheet folding means comprises seal-formation assisting means for assisting the formation of the at least one cohesive seal substantially enclosing the objects within the at least one flexible non-porous sheet;

f) wherein said sheet folding means comprises:

i) moving means for moving the at least one substantially non-porous flexible sheet between the objects and at least one ground surface supporting the objects, and ii) pivoting means for pivoting said moving means about at least one rotational axis; and g) wherein said sheet folding means comprises:

i) releasable retaining means for releasably retaining the at least one substantially non-porous flexible sheet on said sheet holding means prior to formation of the at least one cohesive seal, and ii) releasing means for releasing the at least one substantially non-porous flexible sheet from said sheet holding means on formation of the at least one cohesive seal substantially enclosing the objects within the at least one flexible non-porous sheet.

19. A system related to the collecting of objects by a user using at least one substantially non-porous flexible sheet comprising at least one cohesive surface adapted to form at least one cohesive seal when separate regions of the at least one cohesive surface are brought into contact, said system comprising:

a) at least one sheet holder structured and arranged to hold the at least one substantially non-porous flexible sheet;

b) at least one user grip structured and arranged to assist gripping of said at least one sheet holder by the user;

c) at least one sheet folder structured and arranged to fold the at least one substantially non-porous flexible sheet about the objects;

d) at least one seal-formation assister structured and arranged to assist the formation of the at least one cohesive seal substantially enclosing the objects within the at least one flexible non-porous sheet; and e) at least one manually-operated actuator structured and arranged to assist manual actuation of said at least one sheet folder and said at least one seal-formation assister by the user without direct contact of the at least one substantially non-porous flexible sheet by the user;

f) wherein said at least one sheet folder is pivotably attached to said at least one sheet holder and pivots about at least one rotational axis;

g) wherein said at least one sheet holder remains stationary during pivoting of said at least one sheet folder; and h) wherein said at least one sheet holder comprises:

i) at least one releasable retainer structured and arranged to releasable retain the at least one substantially non-porous flexible sheet on said at least one sheet holder prior to formation of the at least one cohesive seal, and ii) at least one releaser structured and arranged to release the at least one substantially non-porous flexible sheet from said at least one sheet holder on formation of the at least one cohesive seal substantially enclosing the objects within the at least one flexible non-porous sheet.

* * * * *